US011072948B2

(12) United States Patent
Patane et al.

(10) Patent No.: US 11,072,948 B2
(45) Date of Patent: Jul. 27, 2021

(54) SMART LATCH

(71) Applicant: Magna Closures Inc., Newmarket (CA)

(72) Inventors: Francesco Patane, Newmarket (CA); Carlo Quartieri, Pontedera (IT); Enrico Boeri, Camaiore (IT)

(73) Assignee: MAGNA CLOSURES S.P.A., Guasticce (IT)

( * ) Notice: Subject to any disclaimer, the term of this patent is extended or adjusted under 35 U.S.C. 154(b) by 686 days.

(21) Appl. No.: 15/834,517

(22) Filed: Dec. 7, 2017

(65) Prior Publication Data

US 2018/0163439 A1 Jun. 14, 2018

Related U.S. Application Data

(60) Provisional application No. 62/433,974, filed on Dec. 14, 2016.

(51) Int. Cl.

| | |
|---|---|
| ***E05B 81/14*** | (2014.01) |
| ***E05B 81/42*** | (2014.01) |
| ***E05B 81/06*** | (2014.01) |
| ***E05B 81/16*** | (2014.01) |
| ***E05B 81/36*** | (2014.01) |
| ***E05B 81/50*** | (2014.01) |
| ***E05B 85/26*** | (2014.01) |
| ***E05B 81/20*** | (2014.01) |

(52) U.S. Cl.

CPC ..... *E05B 81/14* (2013.01); *E05B 81/06* (2013.01); *E05B 81/16* (2013.01); *E05B 81/20* (2013.01); *E05B 81/36* (2013.01); *E05B 81/42* (2013.01); *E05B 81/50* (2013.01); *E05B 85/26* (2013.01)

(58) Field of Classification Search

CPC ..... E05B 81/00; E05B 81/06; E05B 81/16; E05B 81/18; E05B 81/14; E05B 81/20; E05B 81/36; E05B 81/42; E05B 81/50; E05B 81/26; Y10T 292/1047; Y10T 292/1082; Y10S 292/23

See application file for complete search history.

(56) References Cited

U.S. PATENT DOCUMENTS

| | | | | |
|---|---|---|---|---|
| 6,764,113 | B1 | 7/2004 | Cetnar | |
| 7,192,066 | B2 | 3/2007 | Ilea et al. | |
| 7,467,815 | B2 | 12/2008 | Larsen et al. | |
| 8,764,075 | B2 | 7/2014 | Taurasi et al. | |
| 9,174,517 | B2 | 11/2015 | Scheuring et al. | |
| 9,512,651 | B2 | 12/2016 | Taurasi et al. | |
| 9,765,554 | B2 | 9/2017 | Cumbo et al. | |
| 10,214,945 | B2 * | 2/2019 | Cetnar | E05B 81/16 |
| 10,450,780 | B2 | 10/2019 | Tomaszewski | |
| 10,655,368 | B2 | 5/2020 | Frello et al. | |
| 10,767,396 | B2 | 9/2020 | Distefano et al. | |

(Continued)

FOREIGN PATENT DOCUMENTS

| | | |
|---|---|---|
| CN | 204311876 U | 5/2015 |
| WO | 2014000084 A1 | 1/2014 |

*Primary Examiner* — Alyson M Merlino

(74) *Attorney, Agent, or Firm* — Dickinson Wright PLLC

(57) ABSTRACT

A latch assembly for a motor vehicle includes a latch mechanism, a power-operated latch release mechanism, and an over-center spring-biased reset mechanism. The power-operated latch release mechanism is operable during a power release operation to shift the reset mechanism from a first over-center operating state into a second over-center operating state.

25 Claims, 16 Drawing Sheets

(56) References Cited

U.S. PATENT DOCUMENTS

| | | | | |
|---|---|---|---|---|
| 2004/0239124 | A1 | 12/2004 | Larsen et al. | |
| 2006/0043740 | A1 | 3/2006 | Torkowski et al. | |
| 2015/0368934 | A1 | 12/2015 | Tomaszewski | |
| 2017/0067272 | A1 | 3/2017 | Margheritti | |
| 2017/0089103 | A1* | 3/2017 | Ottino | E05B 81/06 |
| 2017/0314297 | A1* | 11/2017 | Taurasi | E05B 81/16 |
| 2017/0314298 | A1* | 11/2017 | Tomaszewski | E05B 81/06 |
| 2018/0051494 | A1* | 2/2018 | Scocco | E05B 81/16 |

* cited by examiner

SMART LATCH

CROSS-REFERENCE TO RELATED APPLICATIONS

This application claims the benefit of U.S. Provisional Application No. 62/433,974, filed on Dec. 14, 2016. The entire disclosure of the above application is incorporated herein by reference.

BACKGROUND

The present disclosure relates generally to power closure systems for motor vehicles. More specifically, the present disclosure is directed to a latch assembly configured for installation in a power swing door closure system and having a power-operated latch release mechanism and an over-center reset mechanism.

RELATED ART

This section provides background information related to the present disclosure which is not necessarily prior art.

The passenger doors on motor vehicles are typically mounted by a pair of door hinges to the vehicle body for swinging movement about a generally vertical pivot axis. Such swinging passenger doors ("swing doors") have recognized issues such as, for example, when the vehicle is situated on an inclined surface and the swing door either opens too far or swings shut due to the unbalanced weight of the door. To address this issue, most passenger doors have some type of detent or check mechanism integrated into at least one of the door hinges that functions to inhibit uncontrolled swinging movement of the door by positively locating and holding the door in one or more mid-travel positions in addition to a fully-open position. In some high-end vehicles, the door hinge may include an infinite door check mechanism which allows the door to be opened and held in check at any desired open position. One advantage of passenger doors equipped with door hinges having an infinite door check mechanism is that the door can be located and held in any position to avoid contact with adjacent vehicles or structures.

As a further advancement, power door actuation systems have been developed which function to swing the passenger door about its pivot axis between its closed position and at least one open position. Typically, power door actuation systems include one or more power-operated "presenter" devices such as, for example, an electric motor and a rotary-to-linear conversion device, that are operable for converting the rotary output of the electric motor into translational movement of an extensible member. In most arrangements, the electric motor and the conversion device are mounted within the passenger door and the distal end of the extensible member is fixedly secured to the vehicle body. One example of a power door actuation system is shown in commonly-owned U.S. Pat. No. 9,174,517 which discloses a power-operated presenter device having a rotary-to-linear conversion device configured to include an externally-threaded leadscrew rotatively driven by the electric motor and an internally-threaded drive nut meshingly engaged with the leadscrew and to which the extensible member is attached. Accordingly, control over the speed and direction of rotation of the leadscrew results in control over the speed and direction of translational movement of the drive nut and the extensible member for controlling swinging movement of the passenger door between its open and closed positions.

Higher-end vehicles equipped with power door actuation systems are also equipped with swing doors having a latch assembly typically providing one or more powered features such as, for example, power locking, power release and power cinching functions. Thus, a need exists to coordinate operation of the power-operated presenter device with the powered functions associated with the latch assembly. For example, a need exists to coordinate actuation of the power-operated presenter device to move the door from its closed position into its open position with operation of the power release mechanism to ensure that the ratchet of the latch mechanism has been completely released from the vehicle-mounted striker. Further, the "resetting" of the power release mechanism must be delayed until sufficient movement of the door has occurred to prevent unintended latching of the ratchet to the striker.

In view of the above, there remains a need to develop power-release latch assemblies which can be installed in power swing door systems and have a power release mechanism configured to advance the art while providing increased applicability while reducing cost and complexity.

SUMMARY

This section provides a general summary of the present disclosure and is not a comprehensive disclosure of its full scope or all of its features, aspects and/or objectives.

It is an object of the present disclosure to provide a latch assembly configured for use in a swing-type side door of a motor vehicle and having a power-operated latch release mechanism.

It is a related object of the present disclosure to also provide the latch assembly with an over-center reset mechanism that is operably associated with the power-operated latch release mechanism.

These and other objects of the present disclosure are provided by a latch assembly comprising: a latch mechanism having a ratchet moveable between a striker capture position and a striker release position, a ratchet biasing member for biasing the ratchet toward its striker release position, a pawl moveable between a ratchet holding position for holding the ratchet in its striker capture position and a ratchet releasing position for permitting movement of the ratchet to its striker release position, and a pawl biasing member for biasing the pawl toward its ratchet holding position, a power-operated latch release mechanism having a power release gear operatively connected to the pawl and a power release actuator operable to rotate the power release gear between a rest position whereat the pawl is located in its ratchet holding position and an actuated position whereat the pawl is held in its ratchet releasing position; and reset mechanism configured to function in a first over-center or "holding" state to mechanically hold the power release gear in its actuated position (and the pawl in its ratchet releasing position) while loading a spring-biasing device, and further configured to function in a second over-center or "resetting" state to release the power release gear and allow the spring-biasing device to forcibly move the power release gear back to its rest position.

In accordance with a first aspect of the latch assembly of the present disclosure, the power release actuator includes an electric motor operable to rotate the power release gear in a first or "releasing" direction for movement from its rest position into its actuated position so as to shift the reset mechanism into its first over-center state. The electric motor is further operable to rotate the power release gear in a second or "resetting" direction from its actuated position to a release position so as to shift the reset mechanism into its second over-center state. Thereafter, the spring-biasing device functions to drive the power-operated release gear from its release position into its rest position for resetting the power latch release mechanism.

In accordance with a second aspect of the latch assembly of the present disclosure, the reset mechanism includes a backdrive lever engaging a cam segment of the power release gear and which is moveable between an unloaded position and a fully-loaded position in response to movement of the power release gear between its rest and actuated positions, and a backdrive biasing member arranged to normally bias the backdrive lever toward its unloaded position and which acts as the spring-biasing device of the reset mechanism for loading the backdrive lever.

In accordance with a third aspect, the latch assembly of the present disclosure further includes a manually-operated backup reset mechanism for permitting a vehicle operator to mechanically rotate the power release gear in the resetting direction from its actuated position into its release position to permit the spring-biasing device to thereafter forcibly rotate the power release gear back to its rest position.

As a result of these and other aspects, the latch assembly of the present disclosure functions to mechanically hold the pawl in its ratchet releasing position via the over-center relationship established between reaction forces exerted by the backdrive lever on the cam segment of the power release gear and a rotary axis of the power release gear. Accordingly, this arrangement assures that the latch assembly remains in a released state in the event of a power failure.

Additionally, the reset operation only requires limited actuation of the electric motor to drive the power release gear in the resetting direction from its actuated position to its release position for shifting the reset mechanism from its first over-center state into its second over-center state at which point the spring-loaded backdrive lever takes over to forcibly drive the power release gear back to its rest position. This limited use of the electric motor during the reset operation assures resetting of the power-operated latch release mechanism in the event of a power failure as well as reducing motor noise.

Further, the mechanical backup reset mechanism allows the vehicle operator to backdrive the motor by manually rotating the power release gear from its actuated position to its release position for manually shifting the reset mechanism from its first over-center state into its second over-center state at which point the spring-loaded backdrive lever takes over to forcibly drive the power release gear back to its rest position. This manual actuation of the backup reset mechanism provides tactile feedback as a result of the limited backdriving of the electric motor that is required.

The latch assembly of the present disclosure employs a direct connection between the pawl of the latch mechanism and the power release gear of the power-operated latch release mechanism to provide coordinated movement therebetween. This direct connection is configured in a stacked or overlaid arrangement within the arc travel of the power release gear so as to provide a compact packaging.

Further areas of applicability will become apparent from the description provided herein. The description and specific examples in this summary are intended for purposes of illustration only and are not intended to limit the scope of the present disclosure.

DRAWINGS

The foregoing and other aspects of the present disclosure will now be described by way of example only with reference to the attached drawings, which:

DETAILED DESCRIPTION

Example embodiments of a latch assembly for use in motor vehicle closure systems, constructed in accordance with the teachings of the present disclosure, will now be disclosed. The example embodiments of the latch assembly are further illustrated and described in association with a power swing door actuation system. These example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are described in detail.

Figure 1:
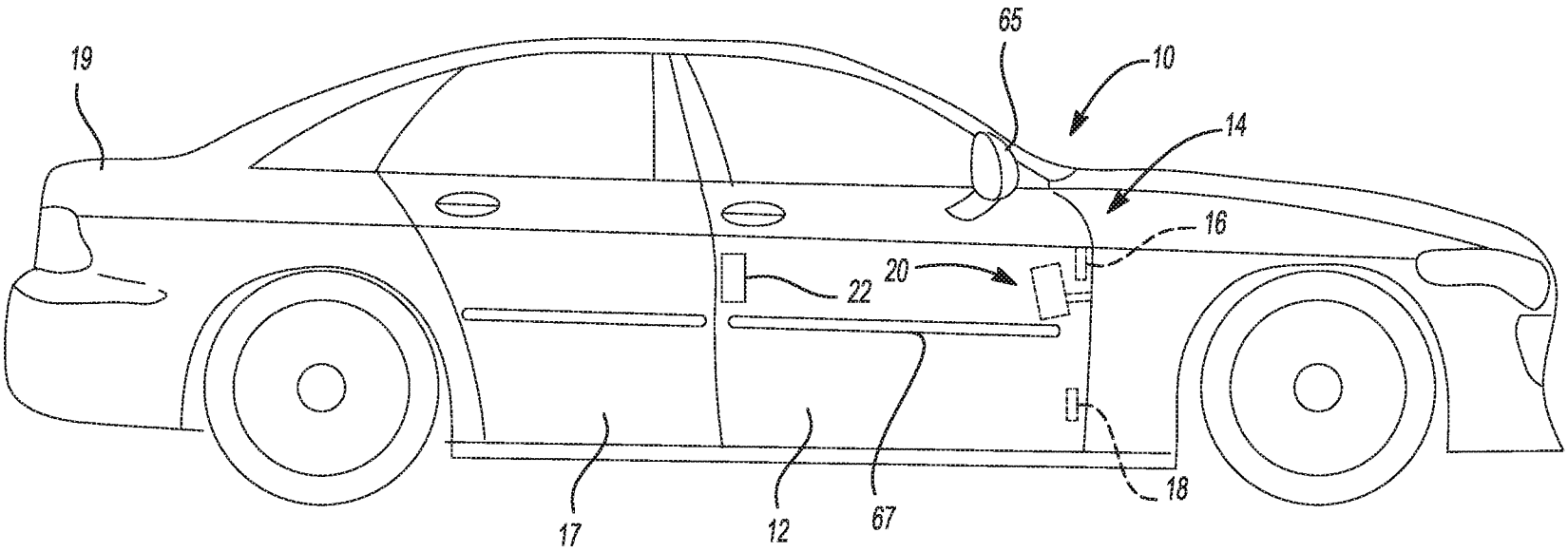
FIG. 1 is a side view of a motor vehicle equipped with a power door actuation system situated between a front passenger swing door and the vehicle body, with the swing door equipped with a latch assembly constructed in accordance with the teachings of the present disclosure.

Referring initially to FIG. 1, an example motor vehicle 10 is shown to include a passenger door 12 pivotally mounted to a vehicle body 14 via an upper door hinge 16 and a lower door hinge 18, which are shown in phantom lines. As will be detailed, door 12 includes a latch assembly 22 capable of releaseably latching door 12 in a closed position relative to vehicle body 14. In addition, a power door actuation system 20 is shown integrated into the pivotal connection between door 12 and vehicle body 14. Power door actuation system 20 generally includes a power-operated swing door actuator, also referred to as a "presenter" device, secured within an internal cavity of passenger door 12. In a non-limiting arrangement, the presenter device includes an electric motor driving a spindle-type rotary-to-linear conversion mechanism with an extensible component that is coupled to a portion of the vehicle body 14. Driven rotation of the spindle drive mechanism via the electric motor causes controlled translational movement of the extensible member which, in turn, controls pivotal movement of door 12 relative to vehicle body 14 between its open and closed positions. While power door actuation system 20 is only shown in association with passenger door 12, those skilled in the art will recognize that the power door actuation system 20 can also be associated with any other door or liftgate of vehicle 10 such as rear passenger doors 17 and decklid 19.

Figure 2:
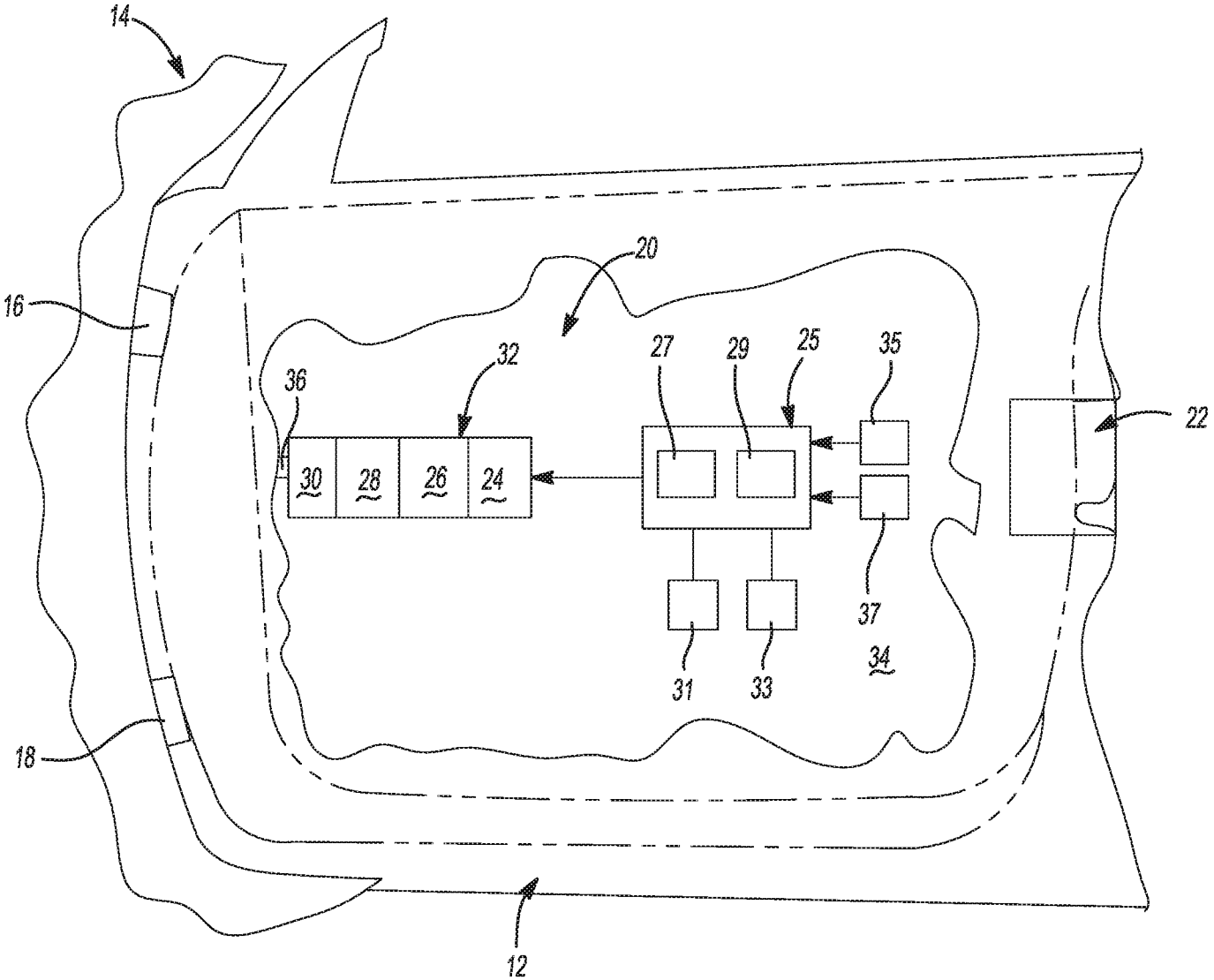
FIG. 2 is a diagrammatic view of the swing door system shown in FIG. 1 and which identifies various components of the power door actuation system in greater detail.
Figure 3:
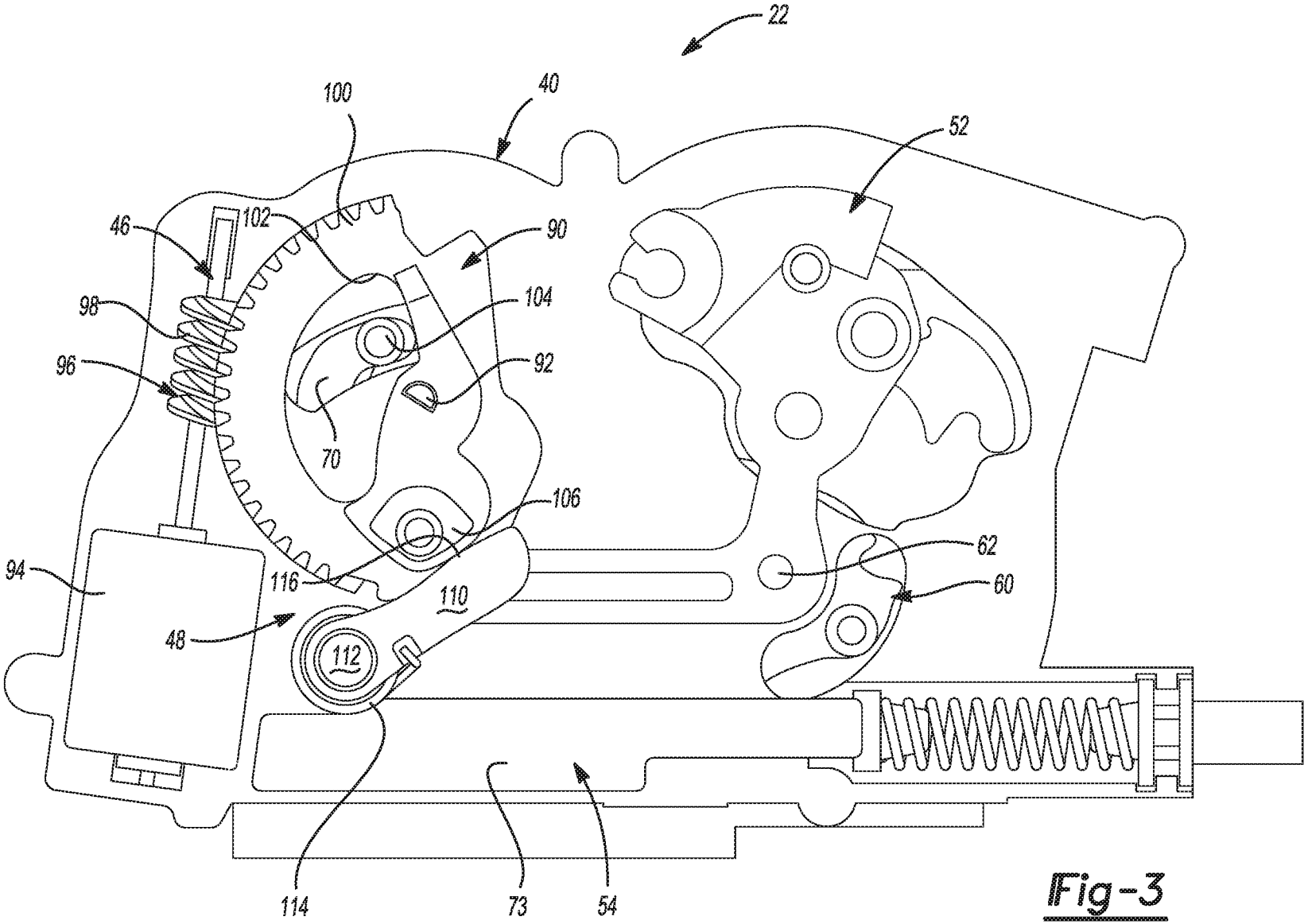
FIG. 3 is a plan view of a latch assembly constructed to embody the teachings of the present disclosure and which is equipped with a latch mechanism, a power-operated latch release mechanism, and a reset mechanism.

Power door actuation system 20 is diagrammatically shown in FIG. 2 to include a power swing door actuator or presenter device 32 configured to include an electric motor 24, a reduction geartrain 26 (or gearbox 26), a slip clutch 28, and a drive mechanism 30. Presenter device 32 is mounted within an interior chamber 34 of door 12. Presenter device 32 further includes a connector mechanism 36 configured to connect an extensible member of drive mechanism 30 to vehicle body 14. As also shown, an electronic control module 25 is in communication with electric motor 24 for providing electric control signals thereto. Electronic control module 25 may include a microprocessor 27 and a memory 29 having executable computer readable instructions stored thereon.

Although not expressly illustrated, electric motor 24 can include Hall-effect sensors for monitoring the position and speed of vehicle door 12 during movement between its open and closed positions. For example, one or more Hall-effect sensors may be provided and positioned to send signals to electronic control module 25 that are indicative of rotational and speed movement of electric motor 24 based on counting signals from the Hall-effect sensor detecting a target on a motor output shaft. In situations where the sensed motor speed is greater than a threshold speed and where the current sensor registers a significant change in the current draw, electronic control module 25 may determine that the user is manually moving door 12 while motor 24 is also operating, thus moving door 12 between its open and closed positions. Electronic control module 25 may then send a signal to electric motor 24 to stop motor 24 and may even disengage slip clutch 28 (if provided). Conversely, when electronic control module 25 is in a power open or power close mode and the Hall-effect sensors indicate that a speed of electric motor 24 is less than a threshold speed (e.g., zero) and a current spike is registered, electronic control module 25 may determine that an obstacle is in the way of door 12, in which case the electronic control system may take any suitable action, such as sending a signal to turn off electric motor 24. As such, electronic control module 25 receives feedback from the Hall-effect sensors to ensure that a contact obstacle has not occurred during movement of door 12 from the closed position to the open position, or vice versa.

As is also schematically shown in FIG. 2, electronic control module 25 may be in communication with a remote key fob 31 or an internal/external handle switch 33 for receiving a request from a user to open or close door 12. Put another way, electronic control module 25 receives a command signal from either remote key fob 31 and/or internal/external handle switch 33 to initiate an opening or closing of door 12. Upon receiving a command, electronic control module 25 proceeds to provide a signal to electric motor 24 in the form of a pulse width modulated voltage (for speed control) to turn on motor 24 and initiate pivotal swinging movement of door 12. While providing the signal, electronic control module 25 also obtains feedback from the Hall-effect sensors of electric motor 24 to ensure that a contact obstacle has not occurred. If no obstacle is present, motor 24 will continue to generate a rotational force to actuate spindle drive mechanism 30. Once door 12 is positioned at the desired location, motor 24 is turned off and the "self-locking" gearing associated with gearbox 26 causes door 12 to continue to be held at that location. If a user tries to move door 12 to a different operating position, electric motor 24 will first resist the user's motion (thereby replicating a door check function) and eventually release and allow the door to move to the newly desired location. Again, once door 12 is stopped, electronic control module 25 will provide the required power to electric motor 24 to hold it in that position. If the user provides a sufficiently large motion input to door 12 (i.e., as is the case when the user wants to close the door), electronic control module 25 will recognize this motion via the Hall effect pulses and proceed to execute a full closing operation for door 12.

Electronic control module 25 can also receive an additional input from an ultrasonic sensor 35, or other proximity sensor such as a radar sensor, positioned on a portion of door 12, such as on a door mirror 65, or the like. Ultrasonic sensor 35 assesses if an obstacle, such as another car, tree, or post, is near or in close proximity to door 12. If such an obstacle is present, ultrasonic sensor 35 will send a signal to electronic control module 25, and electronic control module 25 will proceed to turn off electric motor 24 to stop movement of door 12, and thus prevent door 12 from hitting the obstacle. This provides a non-contact obstacle avoidance system. In addition, or optionally, a contact obstacle avoidance system can be placed in vehicle 10 which includes a contact sensor 37 mounted to door 12, such as in association with molding component 67, and operable to send a signal to control module 25.

Referring now to FIGS. 3 through 13, a first non-limiting example of latch assembly 22 will be described to clearly identify and define the inventive concepts embodied therein. In general, latch assembly 22 includes a latch housing 40 defining a fishmouth striker entry channel 42, a latch mechanism 44, a power-operated latch release mechanism 46, a reset mechanism 48, a manually-operated backup reset mechanism 50, a power-operated cinch mechanism 52, and an inside/outside (IS/OS) latch release mechanism 54.

Latch mechanism 44 includes a ratchet 60 connected via a ratchet pivot post 62 to latch housing 40 for movement between a striker capture position (FIG. 4) and a striker release position, a ratchet biasing member (identified by arrow 64) for normally biasing ratchet 60 toward its striker release position, a pawl 70 connected to latch housing 40 via a pawl pivot post 72 for movement between a ratchet holding position (FIG. 4) and a ratchet releasing position (FIG. 9), and a pawl biasing member (identified by arrow 74) for normally biasing pawl 70 toward its ratchet holding position. With ratchet 60 held in its striker capture position by pawl 70 being located in its ratchet holding position, latch mechanism 44 defines a latched state such that latch assembly 22 is operating in a latched mode. As such, a striker 78 (mounted to vehicle body 14) is held in a guide channel 80 formed in ratchet 60 to hold door 12 in its closed position. In contrast, movement of ratchet 60 to its striker release position upon movement of pawl 70 to its ratchet releasing position defines a released state for latch mechanism 44 such that latch assembly 22 is operating in an unlatched mode. With ratchet 60 located in its striker release position, striker 78 (mounted to vehicle body 14) can be discharged from striker guide channel 80 in ratchet 60 and allow door 12 to be swung to its open position. Upon subsequent closure of door 12, striker 78 engages guide channel 80 and forcibly rotates ratchet 60 into its striker capture position, in opposition to the biasing of ratchet biasing member 64. With ratchet 60 again located in its striker capture position, pawl 70 moves into its ratchet holding position such that a pawl engagement lug 82 engages a primary locking notch 84 formed on ratchet 60, whereby latch assembly 22 is shifted into its latched mode with door 12 held in the closed position. Movement of pawl 70 to its ratchet releasing position, via actuation of power-operated latch release mechanism 46 or IS/OS latch release mechanism 54, permits ratchet biasing member 64 to drive ratchet 60 to its striker release position.

Power-operated latch release mechanism 46 is operable to move pawl 70 from its ratchet holding position into its ratchet releasing position when the release of latch mechanism 44 is desired. Power-operated latch release mechanism 46 generally includes a power release (PR) member configured as a gear 90 rotatably mounted via a gear pivot post 92 to latch housing 40 and a power release actuator for controlling rotation of PR gear 90. The power release actuator includes an electric motor 94 and a gearset 96 having a drive pinion 98 driven by a rotary output of electric motor 94 and a sector gear 100 formed on PR gear 90 that is meshed with drive pinion 98. PR gear 90 also includes a contoured drive slot 102 configured to selectively engage a pawl drive lug 104 extending upwardly from pawl 70. PR gear 90 further includes a raised cam segment 106. As will be detailed, rotation of gearset 96 in a first direction results in rotation of PR gear 90 about a rotary axis established by gear pivot post 92 in a first or "releasing" direction (counterclockwise in FIGS. 3-11) through a first range of travel and defining a plurality of sequential positions including and without limitations, a rest position (FIG. 4), an end of pretravel or a pawl engage position (FIG. 5), a series of intermediate positions (FIGS. 6-8), a pawl release position (FIG. 9), an on-center position (FIG. 10), and an actuated position (FIG. 11). This first range of travel of PR gear 90 in the releasing direction functions to shift latch release mechanism 46 from a non-actuated state to an actuated state for causing the release of latch mechanism 44.

Reset mechanism 48 is generally shown to include a backdrive lever 110 mounted via a backdrive lever pivot post 112 for pivotal movement relative to latch housing 40 between a first or "unloaded" position and a second or "loaded" position, and a spring-biasing device or backdrive lever spring 114 acting to bias backdrive lever 110 toward its unloaded position. Backdrive lever 110 is configured to include a cam follower edge segment 116 engaging and acting upon raised cam segment 106 on PR gear 90 during rotation of PR gear 90 between its rest and actuated positions. As will be detailed, reset mechanism 48 is operable in a first over-center state and a second over-center state to cause loading and release of backdrive lever spring 114.

Figure 4:
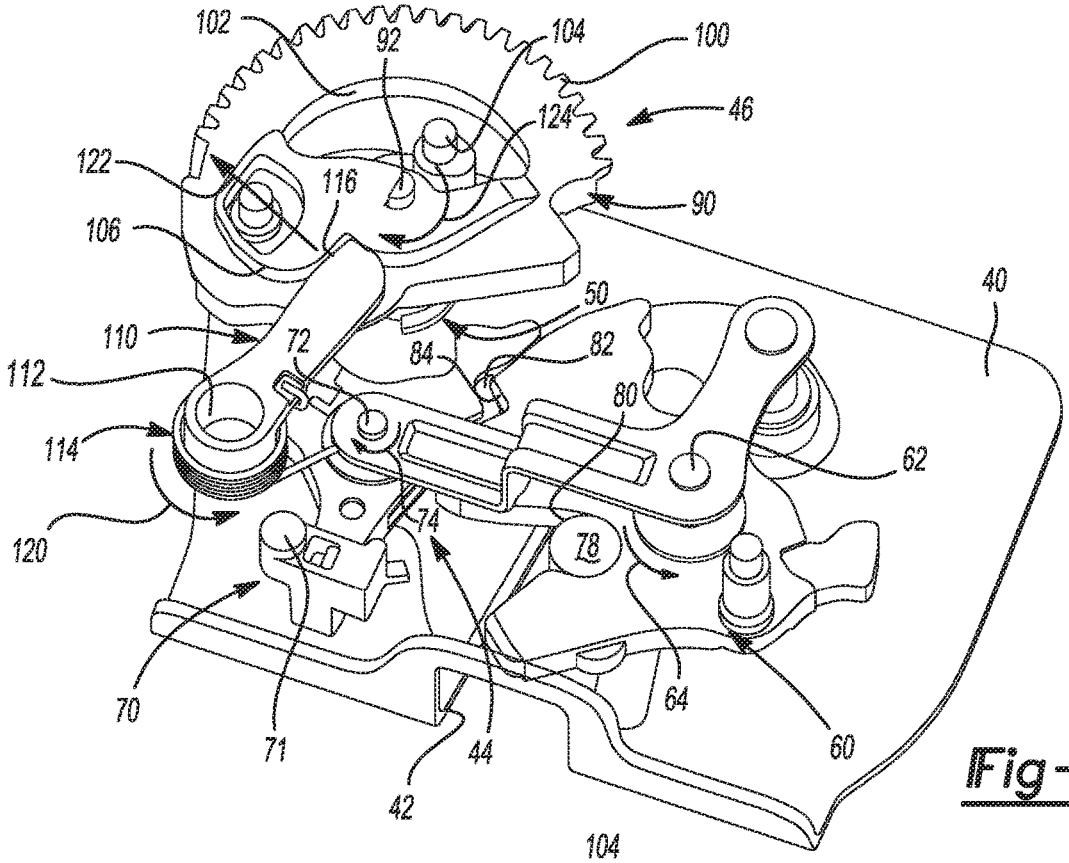
FIG. 4 is an isometric view of the latch assembly shown in FIG. 3 illustrating the interaction of the components with the latch mechanism operating in a latched state, the latch release mechanism operating in a non-actuated state with power release gear located in a "rest" position, and the reset mechanism operating in a first over-center state.

With initial reference to FIG. 4, latch assembly 22 is in its latched mode with latch mechanism 44 operating in its latched state such that ratchet 60 is located in its striker capture position, pawl 70 is located in its ratchet holding position, and PR gear 90 is located in its rest position. With PR gear 90 located in its rest position, pawl drive lug 104 is shown disengaged from drive slot 102. FIG. 4 also shows reset mechanism 48 in its first or "resetting" over-center state. Specifically, backdrive lever 110 is located in its unloaded position. Arrow 120 illustrates the biasing direction applied by backdrive spring 114 on backdrive lever 110 in its unloaded position which, in turn, exerts a reaction force (identified by and directed along arrow 122) against cam segment 106 of PR gear 90. Reaction force 122 is configured to apply a backdrive torque (arrow 124) to PR gear 90 in a second or "resetting" direction (clockwise in FIGS. 3-11).

Figure 5:
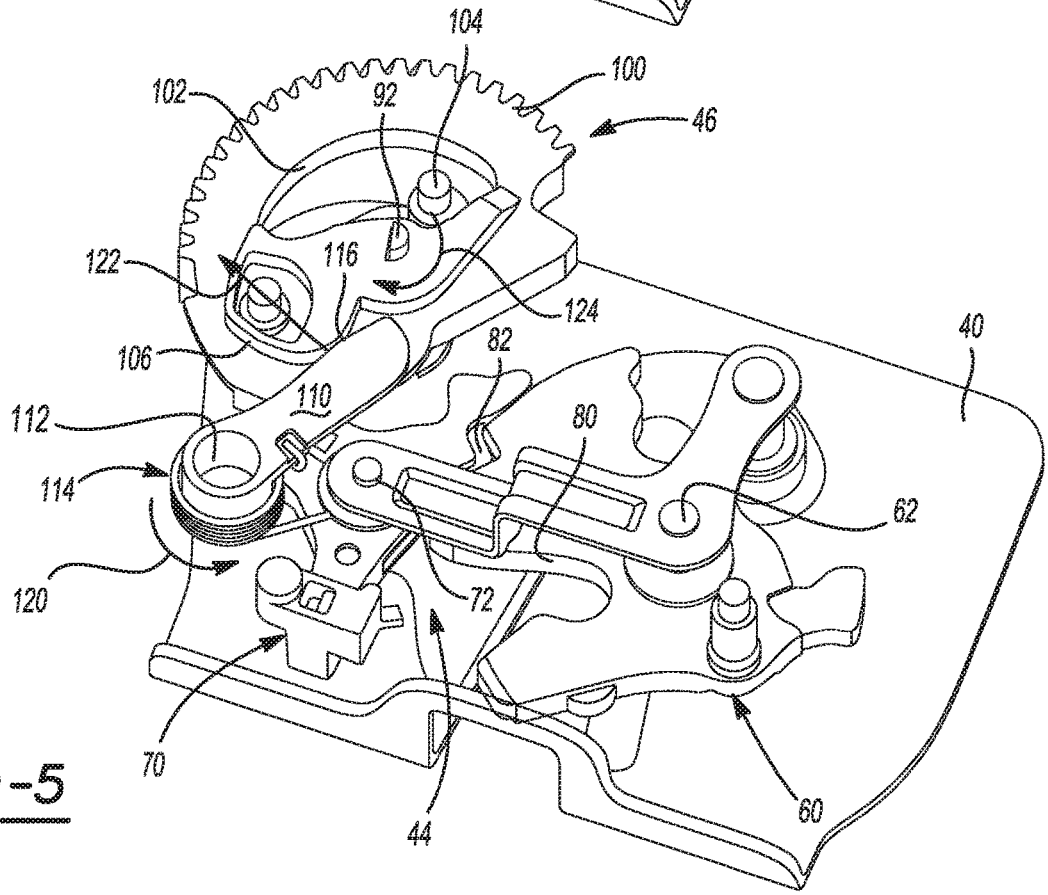
FIG. 5 is similar to FIG. 4 and illustrates the interaction of the components following rotation of the power release gear in a releasing direction from its rest position into an "end of pretravel" position upon initiation of the power release operation.

When it is desired to shift latch mechanism 44 from its latched state into its released state, electric motor 94 is energized to initiate rotation of PR gear 90 in the releasing direction from its rest position toward its pawl engage position (FIG. 5). This first amount of rotation, identified in this non-limiting example to be about 21°, causes pawl drive lug 104 to engage the edge profile of drive slot 102 while reaction force 122 (generated by spring 114 acting on backdrive lever 110) continues to generate backdrive torque 124.

Figure 6:
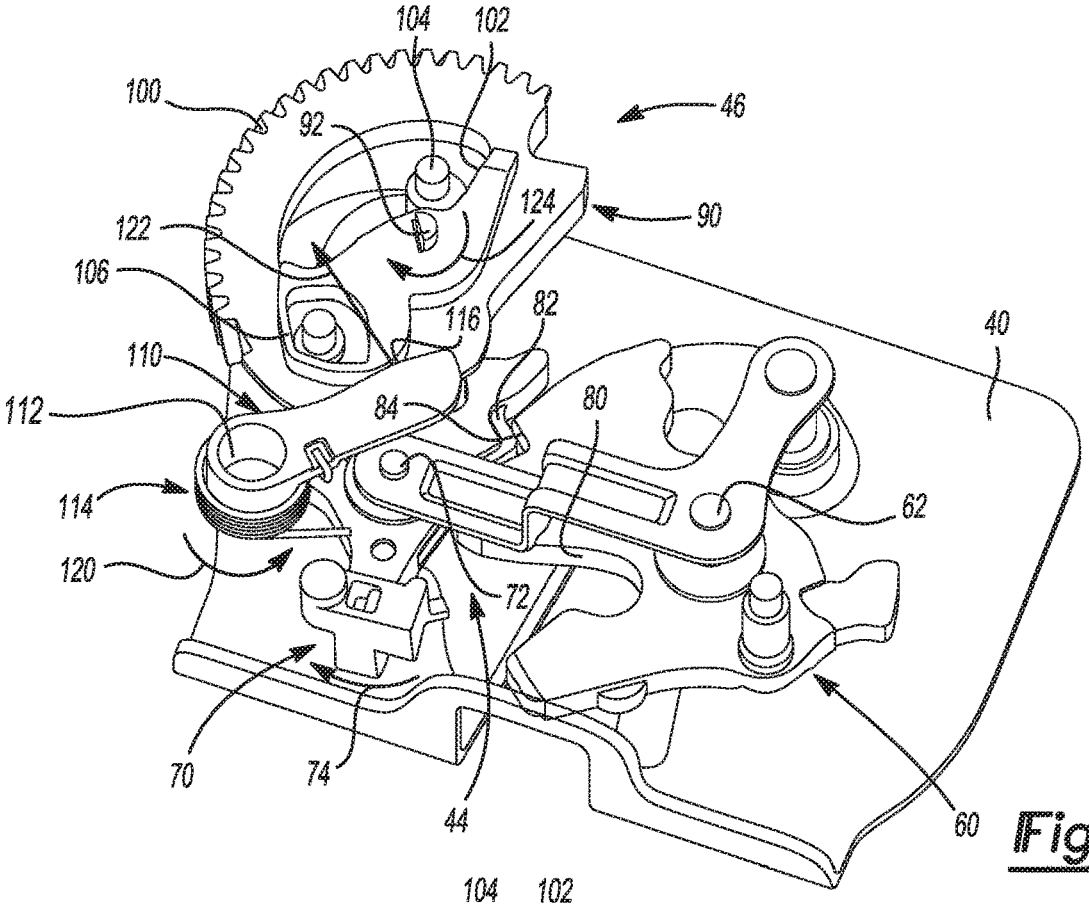
FIGS. 6-9 are likewise similar to FIG. 5 and sequentially illustrate the interaction of the components associated with continued rotation of the power release gear in the releasing direction from its end of pretravel position to a "latch release" position for shifting the latch mechanism into a released state while the reset mechanism is maintained in its first over-center state.
Figure 7:
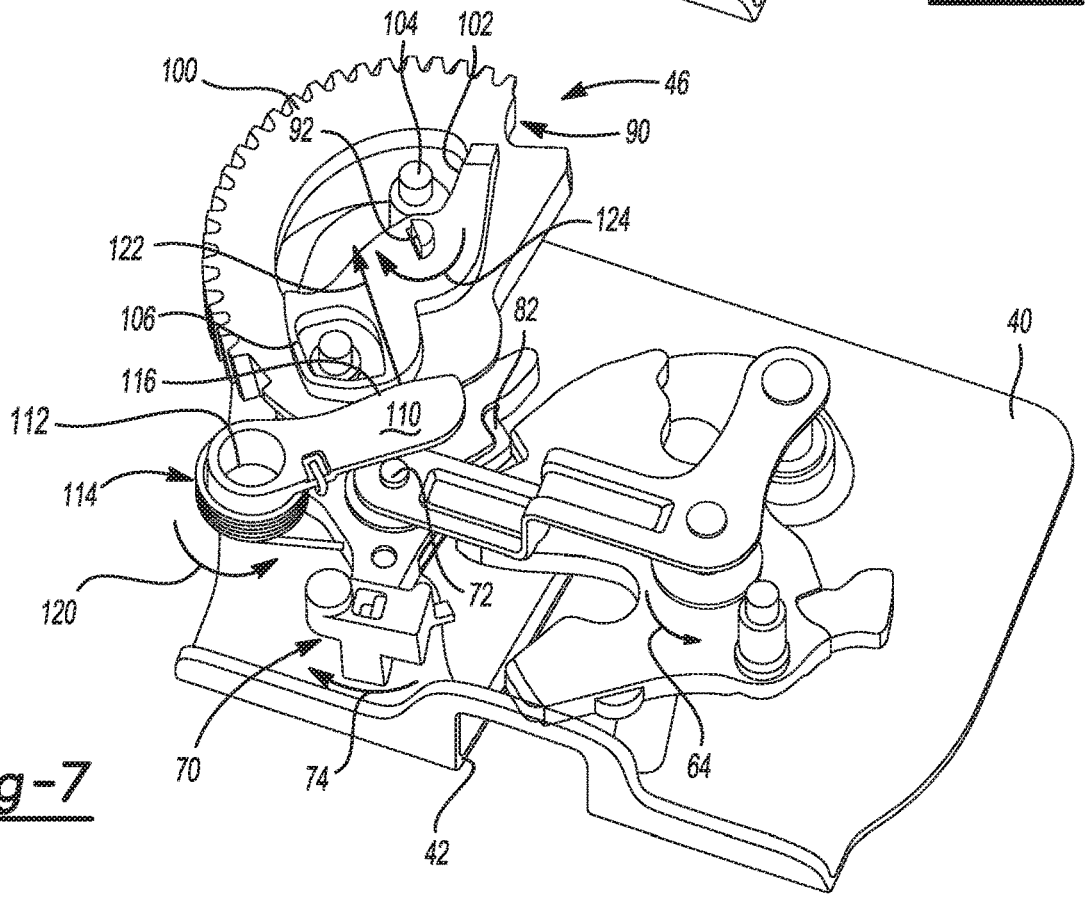
Figure 8:
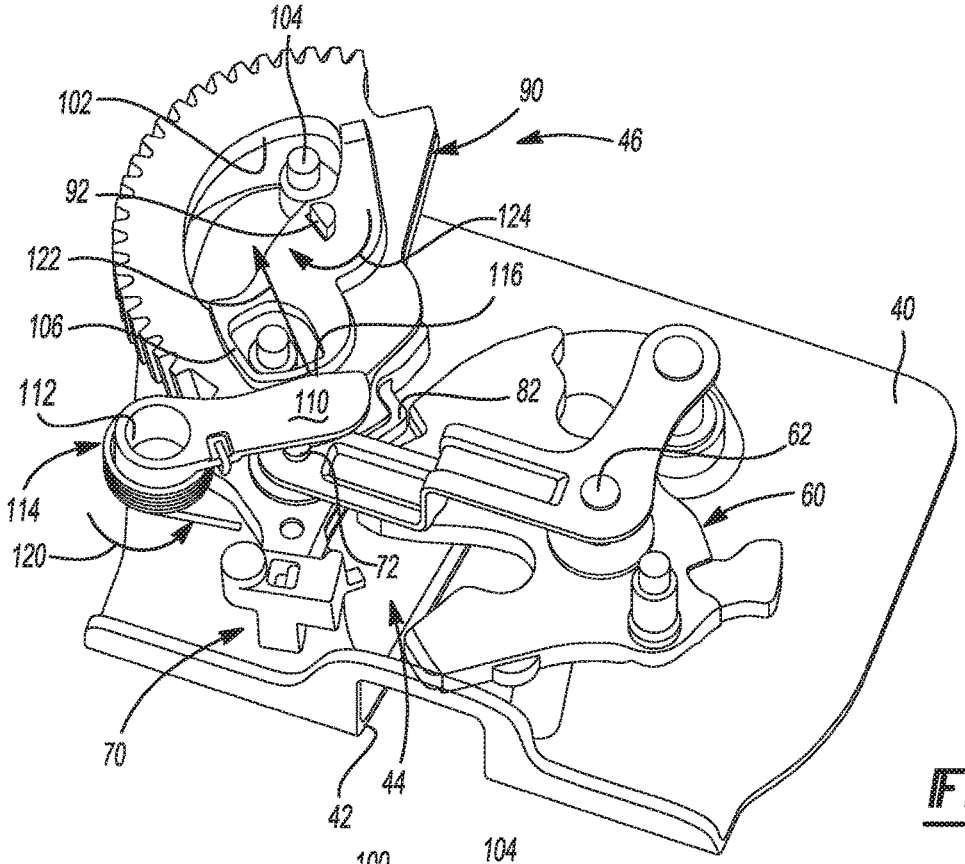

FIGS. 6-8 illustrate that continued rotation of PR gear 90 in the releasing direction causes drive slot 102 to act on pawl drive lug 104 which, in turn, functions to cause pawl 70 to begin to move from its ratchet holding position toward its ratchet releasing position while pawl engagement lug 82 remains engaged with primary locking notch 84 on ratchet 60. Additionally, cam follower edge segment 116 on backdrive lever 110 continues to maintain engagement with cam segment 106 on PR gear 90. However, the interaction therebetween results in vectorial movement of the force line associated with reaction force 122 relative to the rotary axis of PR gear 90 while still continuing to generate backdrive torque 124.

Figure 9:
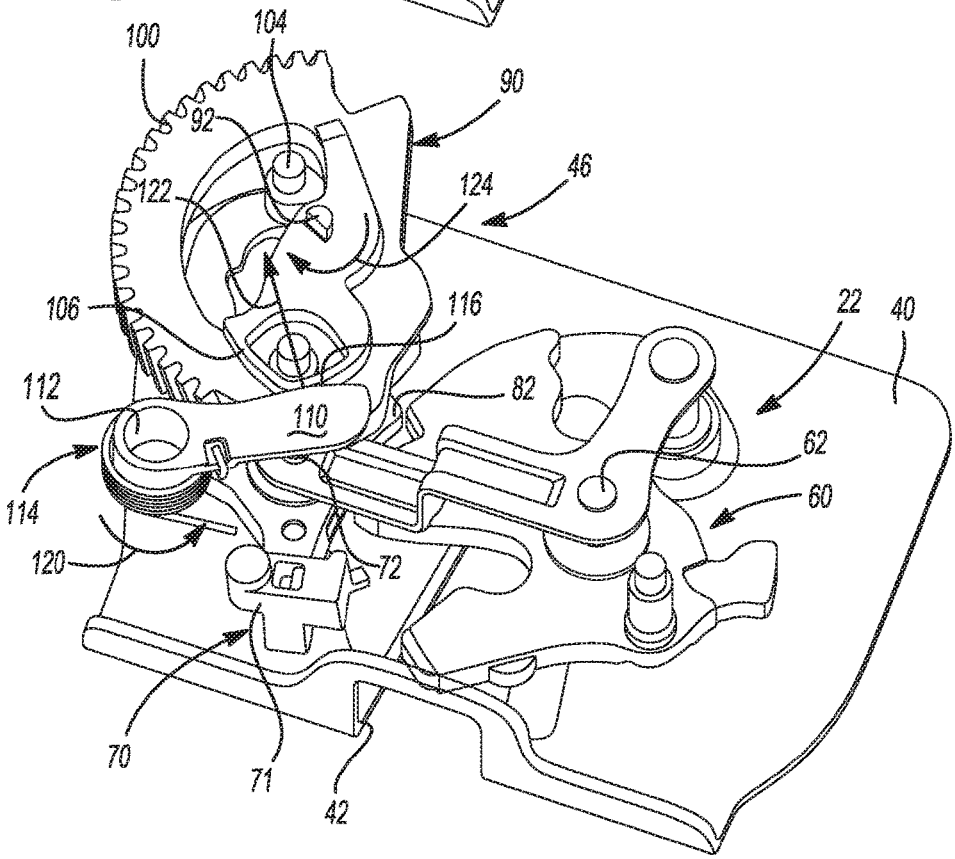

FIG. 9 illustrates continued rotation of PR gear 90 in the releasing direction into its pawl release position whereat pawl 70 has been moved to a position disengaged from ratchet 60 so as to shift latch mechanism 44 into its released state. As such, ratchet biasing member 64 forcibly rotates ratchet 60 to its striker release position and establishes the unlatched mode for latch assembly 22. This pawl release position has occurred, in this non-limiting example, after about 77° of rotation of PR gear 90 from its rest position such that pawl engagement lug 82 is no longer in engagement with primary locking notch 84 on ratchet 60. With PR gear 90 in position, the line of force associated with reaction force 122 (generated by engagement of backdrive lever 110 with cam segment 106) continues to establish the first over-center relationship between reaction force 122 and the rotary axis of PR gear 90 while still generating backdrive torque 124. Thus, reset mechanism 48 is located to function in a resetting state.

Figure 10:
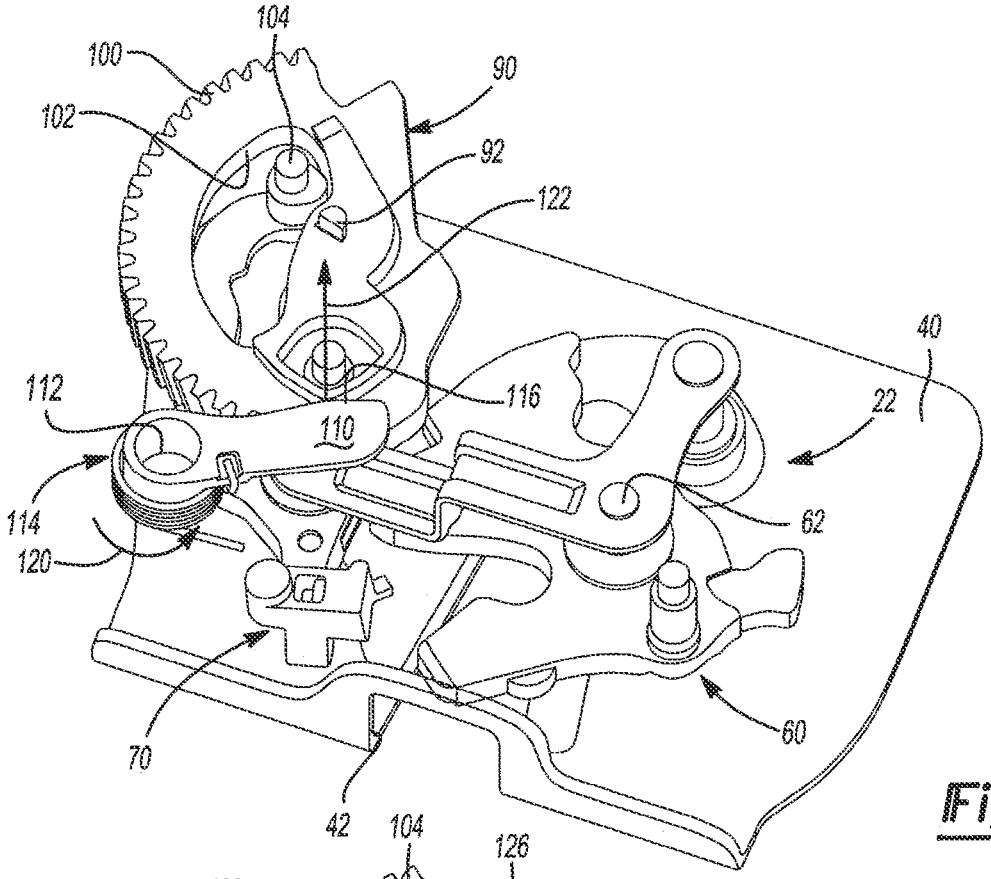
FIGS. 10 and 11 show the interaction and movement of the components of the latch assembly upon continued rotation of the power release gear in the releasing direction from its latch released position into an "actuated" position and which causes the reset mechanism to shift from its first over-center state into a second over-center state.
Figure 11:
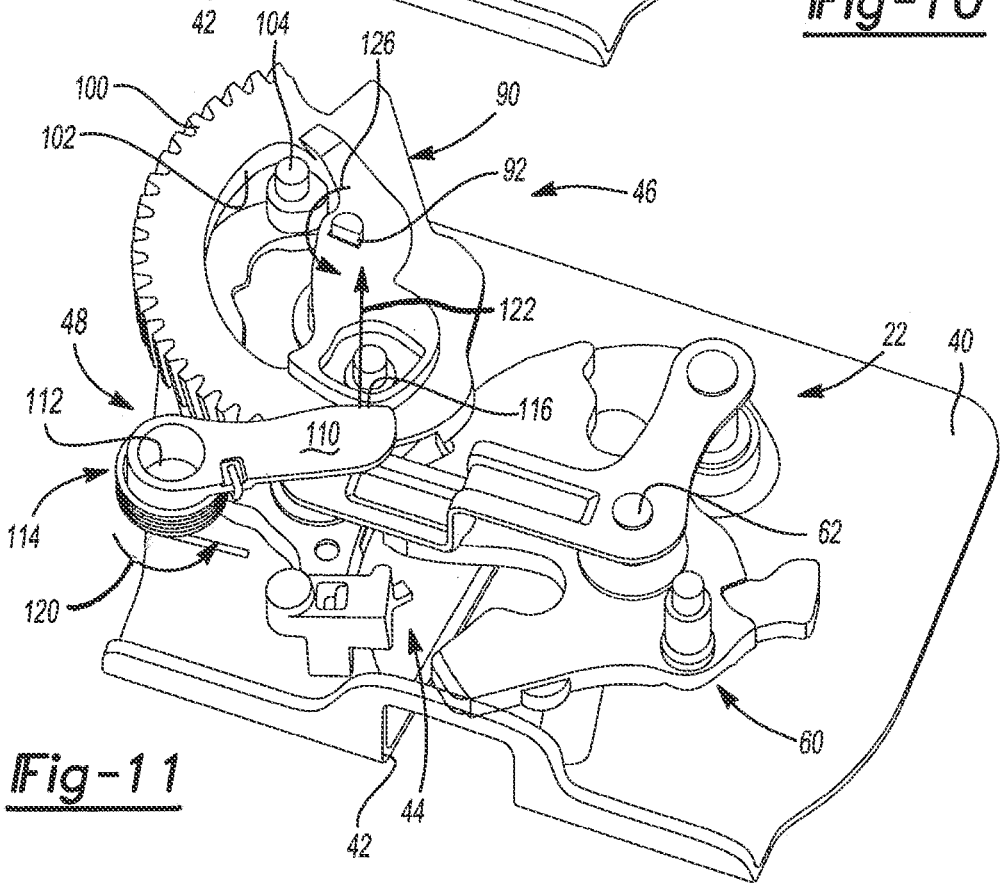

FIG. 10 illustrates that slightly more rotation of PR gear 90 in the releasing direction results in the line of force associated with reaction force 122 (generated by engagement of backdrive lever 110 with cam segment 106) establishes an on-center relationship with respect to the rotary axis, whereby no backdrive torque is generated and applied by reset mechanism 48 to PR gear 90.

FIG. 11 illustrates continued rotation of PR gear 90 in the releasing direction into its actuated position whereat pawl 70 is mechanically held by PR gear 90 in its ratchet releasing position. In this non-limiting example, rotation of about 100° is required to rotate PR gear 90 from its rest position to its actuated position. Here, backdrive lever 110 is located in its loaded position such that the line of force associated with reaction force 122 has established the second or "holding" over-center state with respect to the rotary axis of PR gear 90, whereby a negative (counterclockwise) backdrive torque is generated, as identified by arrow 126. Thus, reset mechanism 48 now defines a holding state. In this position, motor 94 can be turned off and the interaction between backdrive lever 110 and cam segment 106 is solely responsible for mechanically holding PR gear 90 in its actuated position which, in turn, continues to hold pawl 70 in its ratchet releasing position.

To subsequently return reset mechanism 48 to its resetting state, once a signal has been received by control module 25 indicating that door 12 has moved to its open position, motor 94 is actuated to rotate gearset 96 in a second direction so as to cause rotation of PR gear 90 in the second or "resetting" direction about its rotary axis through a second range of rotary motion required to rotate PR gear 90 from its actuated position (FIG. 11) to its pawl release position (FIG. 9). This limited rotation (about 23°) of PR gear 90 in the resetting direction via actuation of motor 94 results in backdrive lever 110 moving from its second over-center position (FIG. 11) through its on-center position (FIG. 10) into its first over-center position (FIG. 9). With backdriver lever 110 positioned in its first over-center position (FIG. 9), the reaction force 122 applied by backdrive lever 110 on cam segment 106 (due to the biasing exerted by spring 114) forcibly drives PR gear 90 in the resetting direction from its pawl release position (FIG. 9) back to its rest position (FIG. 4). Such rotation of PR gear 90 back to its rest position also permits rotation of pawl 70 back toward its ratchet holding position in preparation for striker 78 subsequently rotating ratchet 60 from its striker release position into its striker capture position whereat pawl 70 can move its engagement lug 82 back into latched engagement with primary locking notch 84 on ratchet 60. The advantage associated with this power-operated resetting operation is that only limited motor actuation is required to drive PR gear 90 from its actuated position to its pawl release position, in conjunction with the subsequent mechanical rotation of PR gear 90 to its rest position via spring-loaded backdrive lever 110. In addition, this arrangement reduces associated motor noise and assists in resetting latch assembly 22 in event of a power failure during the resetting operation.

While not specifically shown in detail, power cinch mechanism 52 is operable to rotate ratchet 60 to its fully cinched primary striker capture position from a secondary striker capture position. Power cinch mechanism 52 may include a power cinch actuator and cinch linkage converting the output of the cinch actuator into rotation of ratchet 60 in the latching direction. Likewise, while not specifically shown in detail, IS/OS latch release mechanism 54 is operable to rotate pawl 70 from its ratchet holding position to its ratchet releasing position in response to selective actuation of an inside handle-operated linkage and/or an outside handle-operated linkage to unlatch/release latch mechanism 44. A lug portion 71 of pawl 70 is coupled via a linkage 73 associated with IS/OS latch release mechanism 54.

Figure 12:
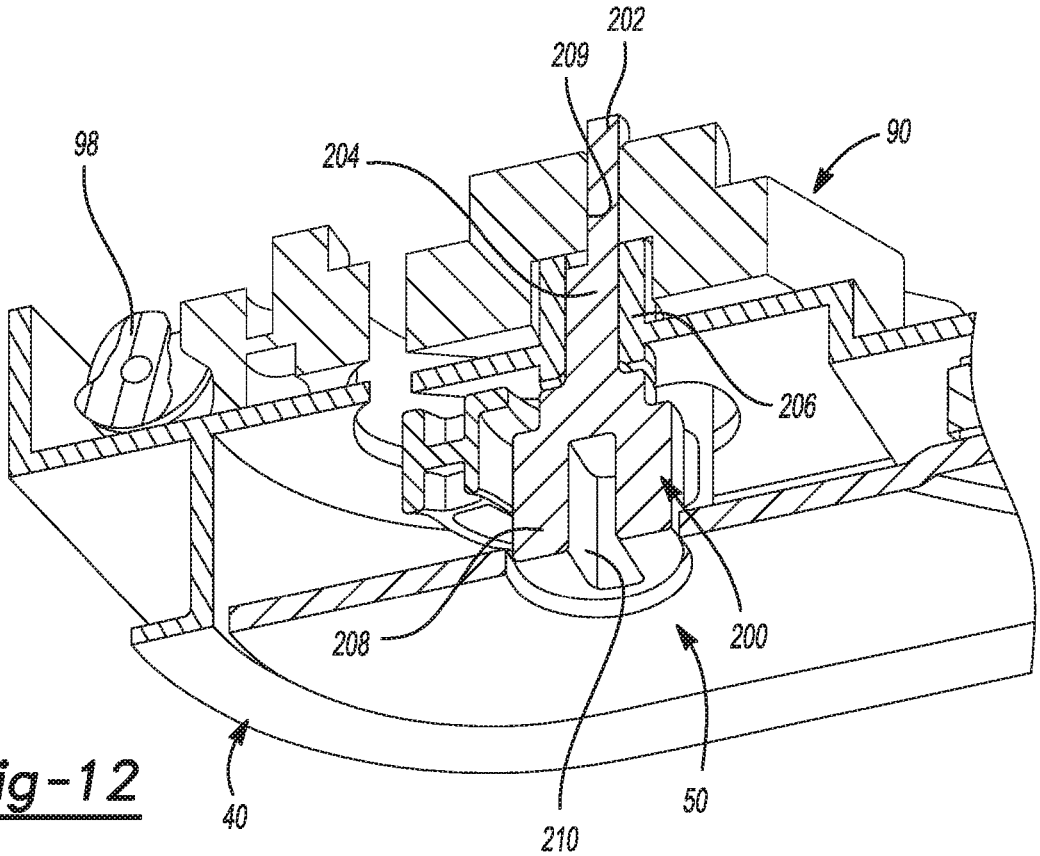
FIGS. 12 and 13 are partial isometric views of the latch assembly illustrating the components associated with a manually-operated backup reset mechanism.
Figure 13:
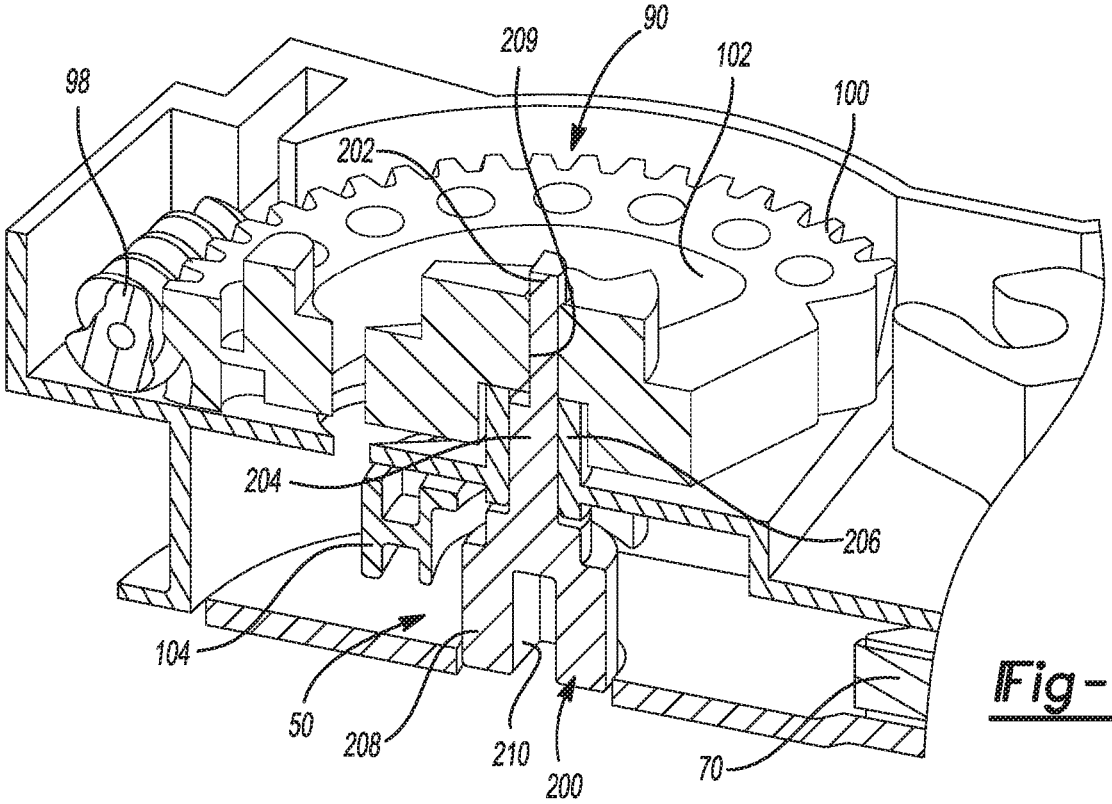

In addition to power-operated reset mechanism 48, latch assembly 22 further includes manually-operated backup reset mechanism 50, as best shown in FIGS. 12 and 13. Backup reset mechanism 50 is generally shown to include a stepped shaft 200 having a first shaft segment 202 defining gear pivot post 92, a second shaft segment 204 defining a journal portion rotatably mounted in a boss portion 206 of latch housing 40, and a third shaft segment 208 defining a key interface having a key slot 210 configured to receive a key. First shaft segment 202 is non-circular and is retained in a complimentary non-circular aperture 209 formed in PR gear 90 such that stepped shaft 200 is directly coupled for common rotation with PR gear 90. In the event of a power failure, the vehicle operator may insert a key into key slot 210 to permit shaft 200 to be manually rotated so as to rotate PR gear 90 from its actuated position to its pawl release position for shifting reset mechanism 48 from its holding state into its resetting state, thereby releasing spring-loaded backdrive lever 110 to continue rotation of PR gear 90 to its rest position. Thus, a manual input is required to actuate the over-center arrangement of reset mechanism 48 and backdrive motor 94 until PR gear 90 is located in its pawl release position. This arrangement provides a tactile feedback to the operator to ensure that latch assembly 22 has been reset.

Latch assembly 22 is also able to synchronize operation of presenter device 32 with the power release function to avoid premature resetting of latch mechanism 44 prior to complete release of striker 78 from ratchet 60. Control would include the steps of: A) initiating power release of latch mechanism 44; B) hold pawl 70 in its ratchet released position via over-center reset mechanism 48 until a signal is received indicating that door 12 is opened; and C) initiating power resetting of latch mechanism 44. Further, automatic resetting only requires a limited "pulse" actuation of power release motor 94 until spring-loaded over-center reset mechanism 48 forcibly drives PR gear 90 to its rest position. This pulsed actuation limits the on-service motor use, reduces motor noise, and also reduces complexity.

Referring now to FIGS. 14-21, an alternative version of a latch mechanism 44' for use in latch assembly 22' is shown to generally incorporate a roller-type pawl/ratchet interface replacing the ratchet locking notch and pawl engagement lug frictional interface previously shown and disclosed. Such a rolling-type interface reduces latch release forces and permits use of a single pawl type latch mechanism in place of conventional double pawl latch mechanisms. To better illustrate the arrangement, pawl 70' is shown laterally offset relative to PR gear 90'. However, the overlaid version shown in FIGS. 3-13 to directly interconnect pawl 70 and PR gear 90 is contemplated for use with latch assembly 22' as an alternative to the non-limiting side-by-side arrangement shown. Note also that reset mechanism 48, while not shown, is again intended to cooperate with the raised cam segment (not shown) on PR gear 90' to provide the reset function. Common primed reference numerals are used hereinafter to identify common components.

Figure 14:
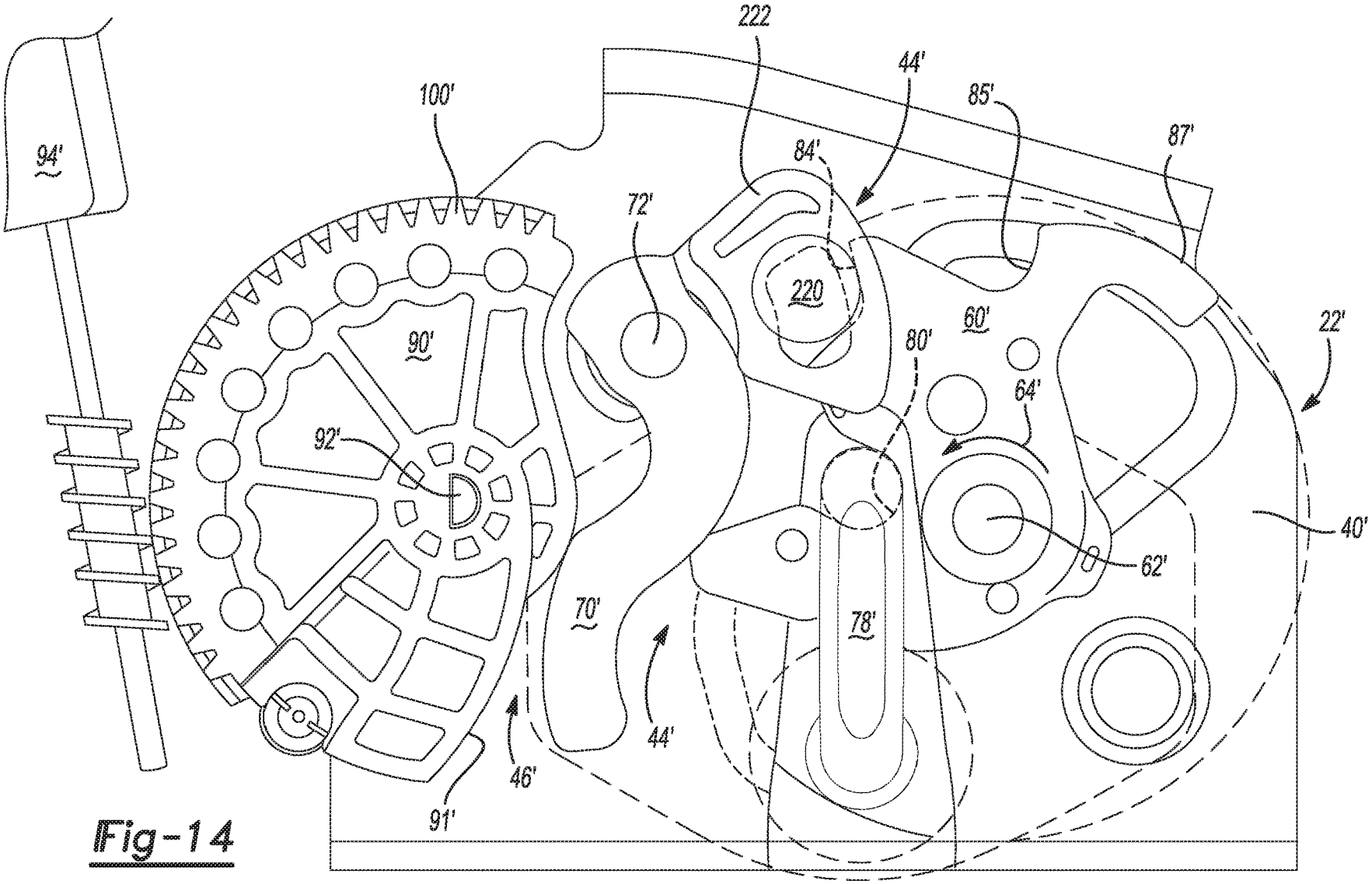
FIG. 14 is a plan view of an alternative embodiment of a latch assembly constructed in accordance with the teachings of the present disclosure and being equipped with a roller pawl latch mechanism (shown operating in a primary latched state) and a power-operated latch release mechanism having a snow load function.
Figure 15:
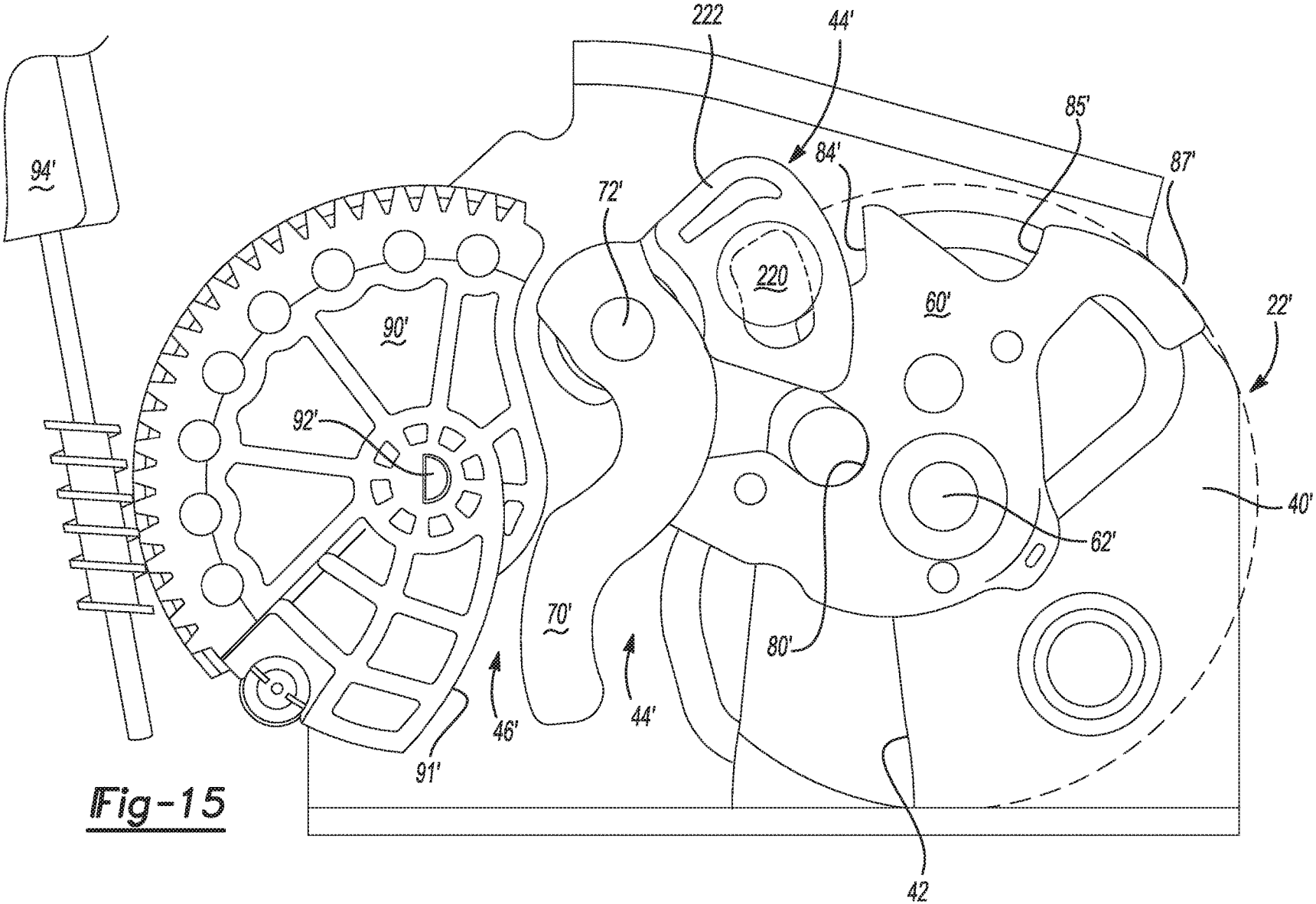
FIG. 15 is similar to FIG. 14 but illustrates rotation of a ratchet associated with the latch mechanism rotates to an "overslam" position.

FIG. 14 illustrates latch mechanism 44' in its latched state with ratchet 60', connected via a ratchet pivot post 62' to a latch housing 40', held in its striker capture position via pawl 70' being located in its ratchet holding position such that striker 78' is held by ratchet 60' and door 12 is latched closed. In the arrangement shown, PR gear 90' of a power-operated latch release mechanism 46' is located in its rest position. FIG. 15 illustrates the components of latch mechanism 44' in response to an "overslam" door event which causes additional rotation of ratchet 60' and which is subsequently overcome via ratchet spring 64'. Note that a roller 220, retained in a cage 222 extending from pawl 70' rolls from a position engaging locking notch 84' on ratchet 60' (FIG. 14) to a position rolling along an overslam surface of ratchet 60' (FIG. 15).

Figure 16:
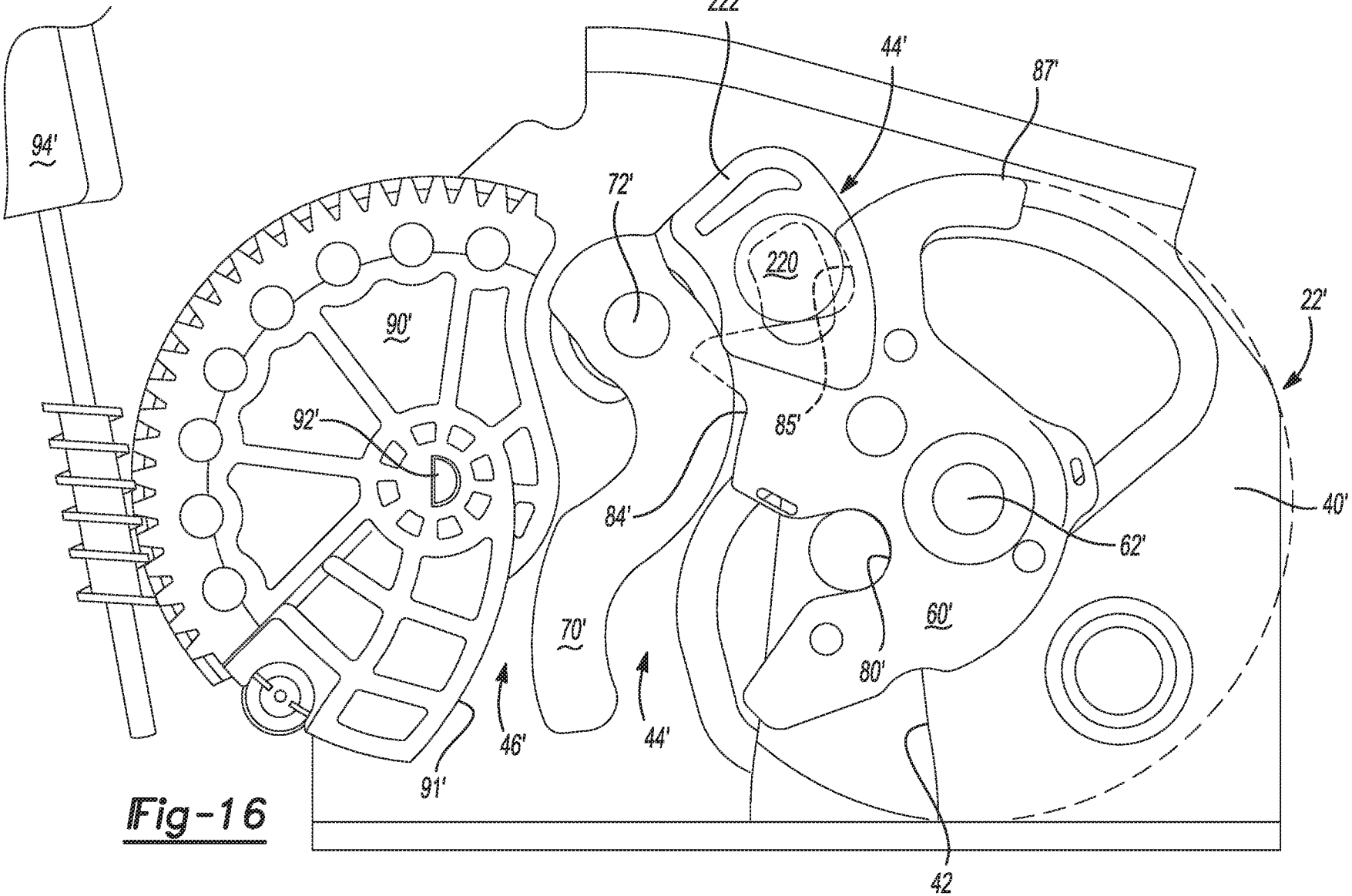
FIG. 16 is also similar to FIG. 14 but illustrates the roller pawl latch mechanism operating in a secondary latched state.
Figure 17:
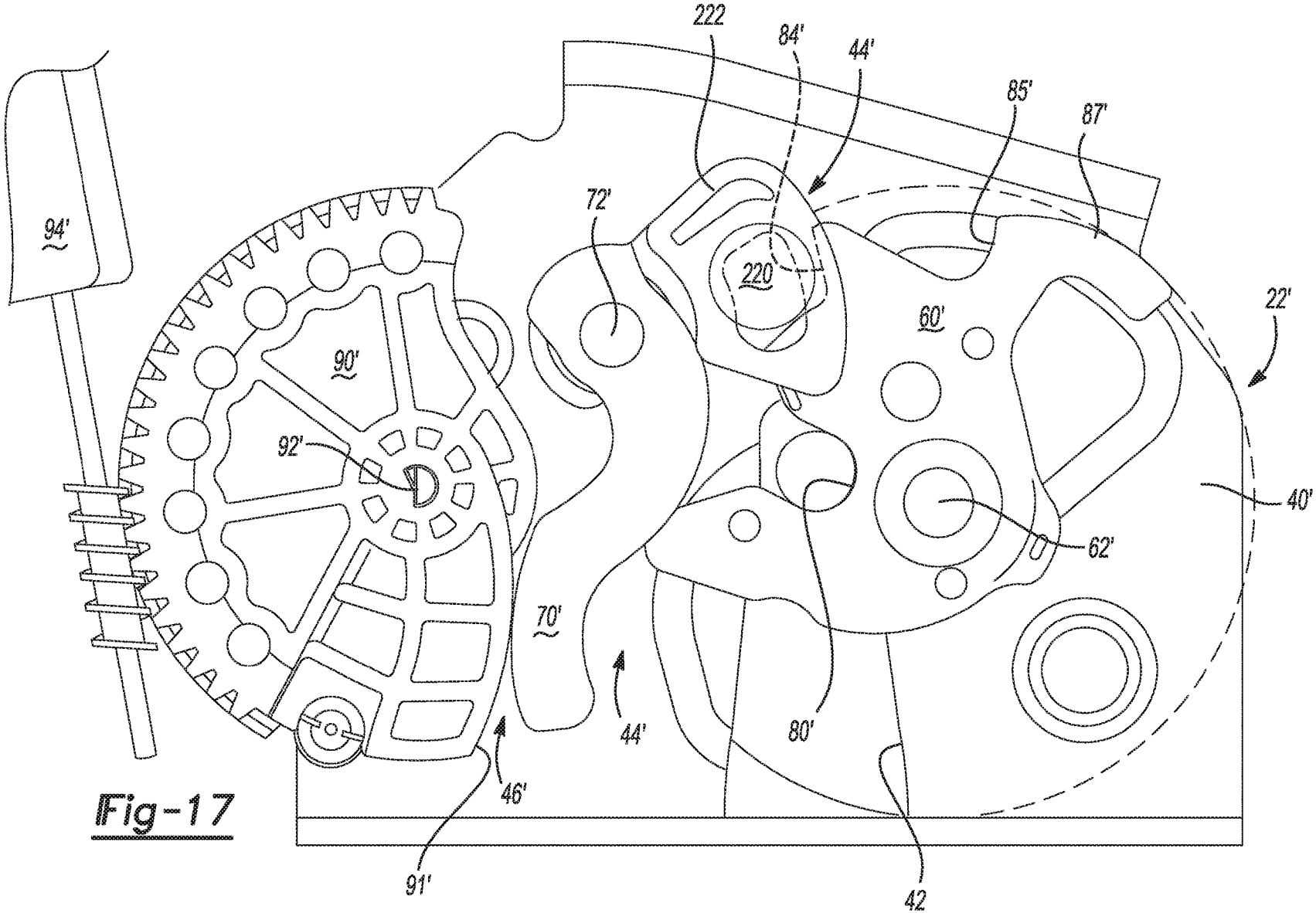
FIGS. 17-19 are also similar to FIG. 14 but sequentially illustrate operation of the power-operated latch release mechanism to provide the power release function.
Figure 18:
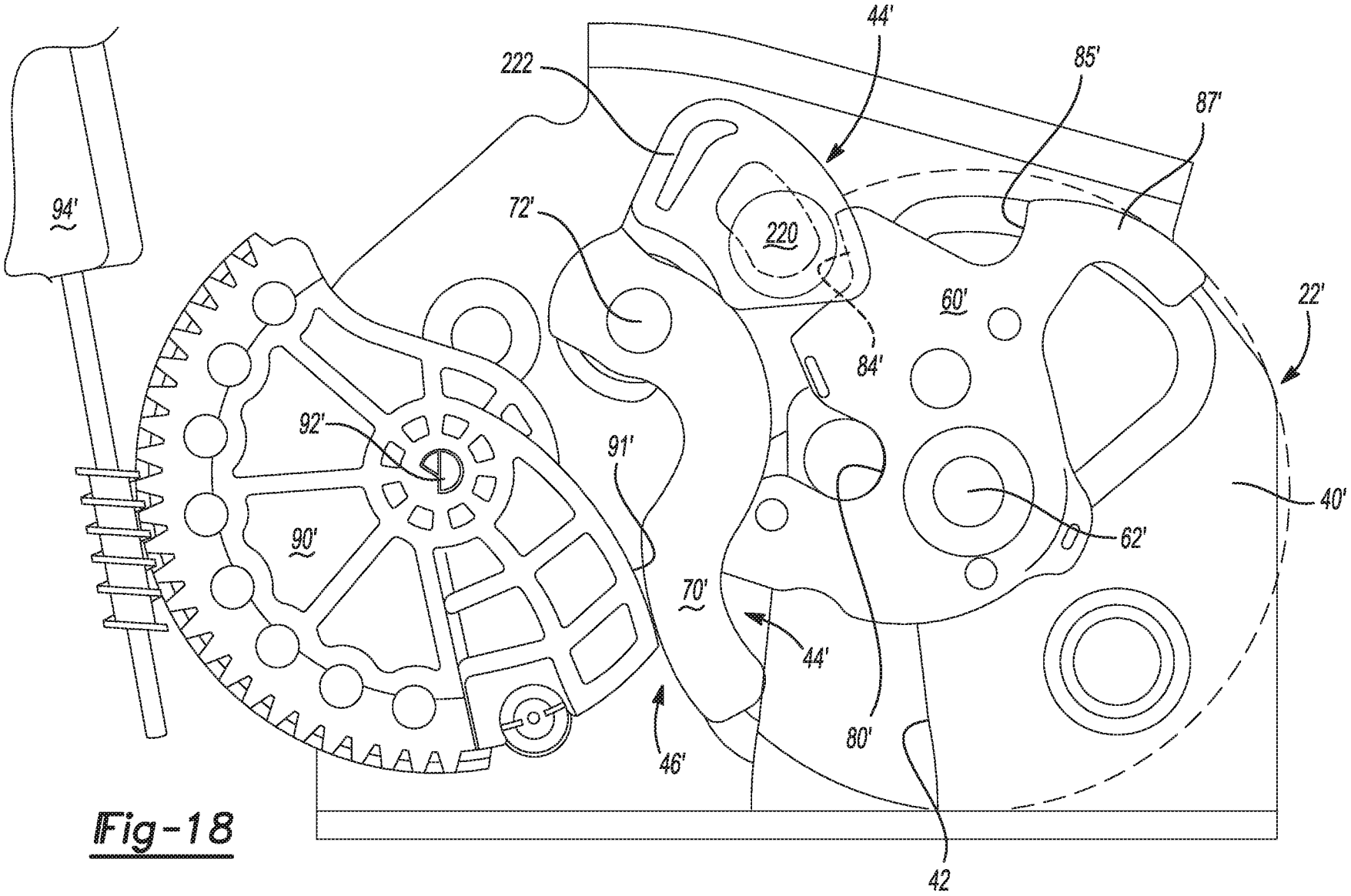

FIG. 16 illustrates a secondary latched state of latch mechanism 44' associated with a soft door close event such that roller 220 now engages a secondary locking notch 85' formed on ratchet 60'. FIG. 17 illustrates the primary latched state of latch mechanism 44' associated with a hard door close event such that roller 220 engages primary locking notch 84' on ratchet 60'. FIG. 17 also shows initial rotation of PR gear 90' in the releasing direction from its rest position (FIG. 14) into its pawl engage position as a result of initiation of the power release operation. FIG. 18 illustrates further rotation of PR gear 90' in the releasing direction to its pawl release position whereat roller 220 is released from primary locking notch 84' for subsequently allowing ratchet spring 64' to drive ratchet 60' to its striker release position.

Figure 19:
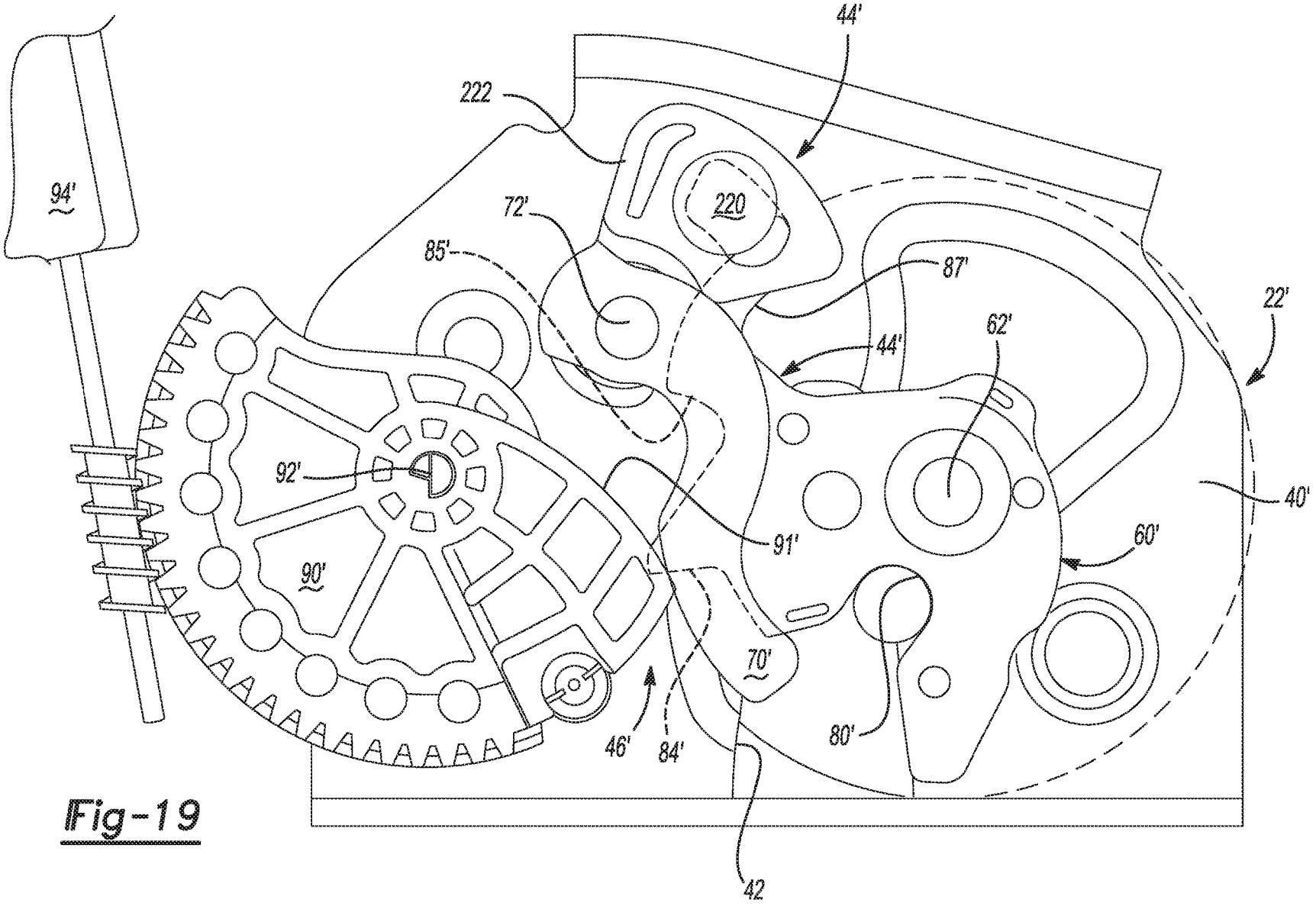

FIG. 19 illustrates ratchet 60' located in its striker release/full open position with PR gear 90' rotated to its actuated position. Note that roller 220 is shown engaging a cam surface 87' on ratchet 60' for holding pawl 70' in its ratchet releasing position. However, integration of power-operated reset mechanism 48 of latch assembly 22 herein would function to have PR gear 90' mechanically held in its actuated position via the over-center relationship such that PR gear 90' could also function to mechanically hold pawl 70' in its ratchet releasing position.

Figure 20:
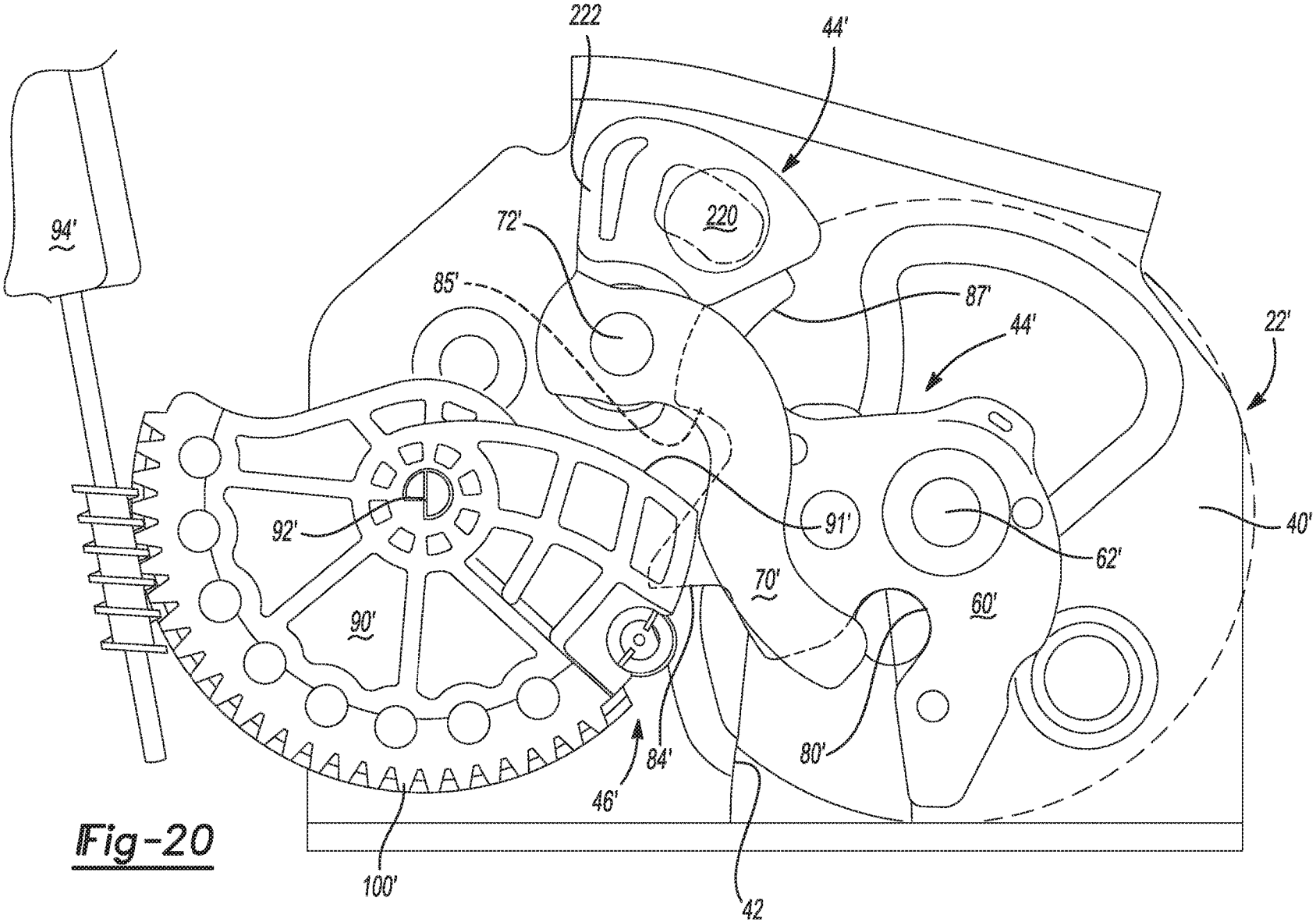
FIGS. 20 and 21 illustrate a snow load function provided by the latch assembly of FIG. 14.
Figure 21:
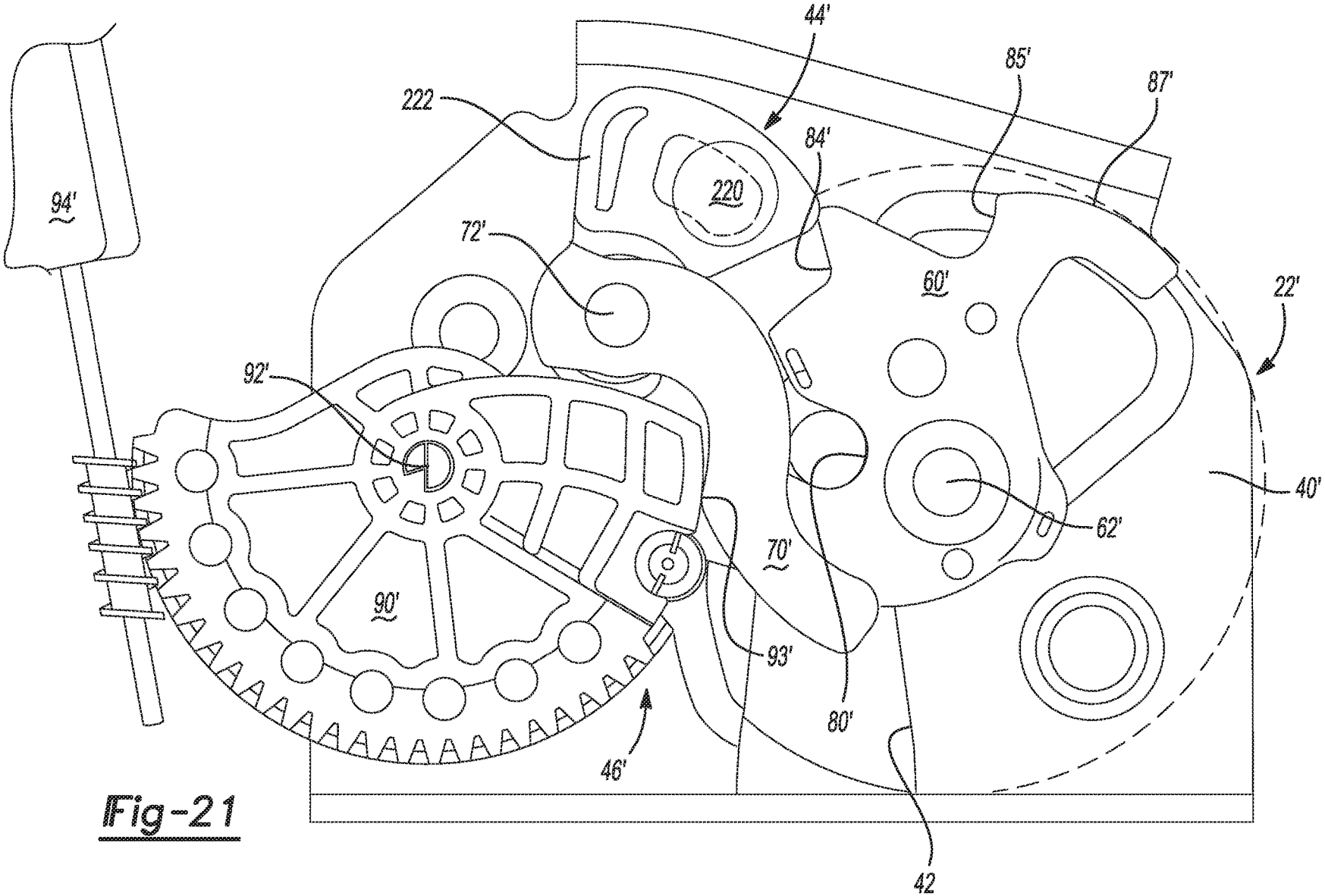

FIG. 20 illustrates continued rotation of PR gear 90' in the releasing direction with ratchet 60' maintained in its striker release/full open position such that a cam edge 91' of PR gear 90' continues to act on pawl 70' for rotating pawl 70' to its full travel position to provide a mechanical holding function (i.e. snow load function). FIG. 21 illustrates a mechanical stop relationship whereat a stop surface 93' on PR gear 90' holds pawl 70' in its full travel position. Reverse rotation of PR gear 90' in the resetting direction is required to return PR gear 90' into its rest position. Additional features of latch mechanism 44' can be recognized in commonly owned U.S. Ser. No. 15/232,179 titled "Automotive Latch Including Bearing to Facilitate Release Effort", the entire disclosure of which is incorporated herein by reference.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A latch assembly for a vehicular door, comprising:

a latch mechanism having a ratchet moveable between a striker capture position and a striker release position, a pawl moveable between a ratchet holding position for holding the ratchet in its striker capture position and a ratchet releasing position for permitting movement of the ratchet to its striker release position, a ratchet biasing member for biasing the ratchet toward its striker release position, and a pawl biasing member for biasing the pawl toward its ratchet holding position;

a latch release mechanism having a gear operatively connected to the pawl and a power-operated actuator operable to rotate the gear in a first direction from a rest position, whereat the pawl is located in its ratchet holding position, to an actuated position, whereat the pawl is located in its ratchet releasing position; and a reset mechanism operable in a first over-center state to mechanically hold the gear in its actuated position, thereby loading a spring-biasing device of the reset mechanism, and operable in a second over-center state to release the gear and permit the spring-biasing device to rotate the gear in a second direction back to its rest position.

2. The latch assembly of claim 1, wherein the power-operated actuator is an electric motor operable to rotate the gear in the first direction through a first range of rotary motion from its rest position into its actuated position so as to shift the reset mechanism from its second over-center state into its first over-center state, and wherein the electric motor is operable to rotate the gear in the second direction through a second range of rotary motion from its actuated position into a released position so as to shift the reset mechanism from its first over-center state into its second over-center position state.

3. The latch assembly of claim 2, wherein the first range of rotary motion is greater than the second range of rotary motion.

4. The latch assembly of claim 2, wherein the spring-biasing device functions to rotate the gear from its released position into its rest position.

5. The latch assembly of claim 4, wherein the spring-biasing device includes a backdrive lever having a drive segment engaging a cam segment formed on the gear, the backdrive lever being moveable between a first position, when the gear is located in its rest position, and a second position, when the gear is located in its actuated position, and a backdrive lever spring arranged to normally bias the backdrive lever toward its first position, and wherein movement of the backdrive lever from its first position to its second position in response to rotation of the gear from its rest position to its actuated position acts to load the backdrive lever spring, thereby loading the spring-biasing device.

6. The latch assembly of claim 5, wherein the first position of the backdrive lever is a first over-center position relative to a rotary axis of the gear, corresponding to the first over-center state of the reset mechanism, and wherein the second position of the backdrive lever is a second over-center position relative to the rotary axis of the gear, corresponding to the second over-center state of the reset mechanism.

7. The latch assembly of claim 6, wherein a reaction load exerted by the backdrive lever on the cam segment generates a positive backdrive torque on the gear when the gear is rotated in the first direction to its released position, such that the reaction load is directed along a line of force so as to establish the second over-center position of the backdrive lever, and wherein the reaction load exerted by the backdrive lever on the cam segment generates a negative backdrive torque on the gear when the gear is rotated in the first direction from its released position into its actuated position such that the reaction load is directed along a line of force so as to establish the first over-center position of the backdrive lever.

8. The latch assembly of claim 7, wherein rotation of the gear by the electric motor in the second direction from its actuated position to its released position permits the reaction load applied via the backdrive lever to forcibly rotate the gear from its released position to its rest position.

9. The latch assembly of claim 1, wherein the pawl is overlaid with respect to the gear and includes a pawl drive lug retained in a drive slot formed in the gear to coordinate movement therebetween.

10. The latch assembly of claim 9, wherein the pawl is located in its ratchet holding position when the gear is located in its rest position, and wherein the pawl is located in its ratchet releasing position when the gear is located in its actuated position.

11. The latch assembly of claim 9, wherein the ratchet includes a locking notch configured to engage a latching feature on the pawl when the pawl is located in its ratchet holding position, thereby holding the ratchet in its striker capture position.

12. The latch assembly of claim 11, wherein the latching feature on the pawl is a locking lug.

13. The latch assembly of claim 11, wherein the latching feature on the pawl is a roller.

14. The latch assembly of claim 2 further comprising a manually-operated backup reset mechanism configured to permit a user to rotate the gear in the second direction through the second range of rotary motion from its actuated position into its released position so as to allow the spring-biasing device to rotate the gear from its released position to its rest position.

15. A latch assembly for a vehicle door, comprising:

a latch mechanism having a ratchet moveable between a striker capture position and a striker release position, and a pawl moveable between a ratchet holding position, whereat the pawl holds the ratchet in its striker capture position, and a ratchet releasing position, whereat the pawl permits movement of the ratchet to its striker release position;

a latch release mechanism including a release member connected to the pawl and moveable between a rest position, whereat the release member permits the pawl to be located in its ratchet holding position, and an actuated position, whereat the release member holds the pawl in its ratchet releasing position, and a power release actuator operable to move the release member from its rest position into its actuated position; and a reset mechanism including a backdrive lever, engaging a cam formed on the release member, and which is moveable between a first over-center position relative to the release member when the release member is located in its rest position, and a second over-center position relative to the release member when the release member is located in its actuated position, and a spring-loaded device acting to bias the backdrive lever toward its first over-center position, wherein the spring-loaded device causes the backdrive lever to exert a positive backdrive torque on the release member when the backdrive lever is located in its first over-center position, and wherein the spring-loaded device causes the backdrive lever to exert a negative backdrive torque on the release member when the backdrive lever is located in its second over-center position.

16. The latch assembly of claim 15, wherein the movement of the release member is rotation, and wherein the release member is a power release (PR) gear rotatable about an axis of the PR gear, wherein the cam formed on the PR gear is configured to direct a reaction force generated by the spring-loaded device acting on the backdrive lever along a first side of the axis of the PR gear when the PR gear is located in its rest position, and wherein the cam formed on the PR gear is further configured to direct the reaction force along a second side of the axis of the PR gear when the PR gear is located in its actuated position.

17. The latch assembly of claim 16, wherein the power release actuator is an electric motor operable to rotate the PR gear in a first direction through a first range of motion from its rest position into its actuated position so as to move the backdrive lever from its first over-center position to its second over-center position, and wherein the electric motor is operable to rotate the PR gear in a second direction through a second range of motion from its actuated position into a released position so as to move the backdrive lever from its second over-center position to its first over-center position, and wherein the first range of motion is greater than the second range of motion.

18. The latch assembly of claim 17, wherein the backdrive lever holds the PR gear in its actuated position when the backdrive lever is located in its second over-center position.

19. The latch assembly of claim 18, wherein movement of the backdrive lever from its second over-center position to its first over-center permits the spring-loaded device to drive the PR gear from its released position into its rest position.

20. The latch assembly of claim 17 further comprising a manually-operated backup reset mechanism configured to permit a user to rotate the PR gear in the second direction through the second range of motion from its actuated position into its released position so as to allow the spring-biasing device to rotate the PR gear from its release position to its rest position.

21. A latch assembly for a vehicular door, comprising:

a latch mechanism having a ratchet moveable between a striker capture position and a striker release position, a pawl moveable between a ratchet holding position for holding the ratchet in its striker capture position and a ratchet releasing position for permitting movement of the ratchet to its striker release position, a ratchet biasing member for biasing the ratchet toward its striker release position, and a pawl biasing member for biasing the pawl toward its ratchet holding position;

a latch release mechanism having a gear operatively connected to the pawl and a power-operated actuator operable to rotate the gear in a first direction from a rest position, whereat the pawl is located in its ratchet holding position, to an actuated position, whereat the pawl is located in its ratchet releasing position; and a reset mechanism operable in a holding state to mechanically hold the gear in its actuated position, thereby loading a spring-biasing device of the reset mechanism, and operable in a resetting state to release the gear and permit the spring-biasing device to rotate the gear in a second direction back to its rest position.

22. The latch assembly of claim 21, wherein the reset mechanism, while in the holding state, mechanically holds the gear in its actuated position while the power-operated actuator is not powered.

23. The latch assembly of claim 21, wherein the holding state corresponds to a first over-center state of the reset mechanism and the resetting state corresponds to a second over-center state of the reset mechanism.

24. The latch assembly of claim 23, wherein the first over-center state and the second over-center state are with respect to a rotary axis of the gear.

25. The latch assembly of claim 23, wherein the power-operated actuator is an electric motor operable to rotate the gear in the first direction through a first range of rotary motion from its rest position into its actuated position so as to shift the reset mechanism from its second over-center state into its first over-center state, and wherein the electric motor is operable to rotate the gear in the second direction through a second range of rotary motion from its actuated position into a released position so as to shift the reset mechanism from its first over-center state into its second over-center state.

* * * * *